US008342672B2

(12) United States Patent
Yamashita et al.

(10) Patent No.: US 8,342,672 B2
(45) Date of Patent: Jan. 1, 2013

(54) RECORDING APPARATUS

(75) Inventors: Kunichi Yamashita, Kanagawa (JP); Hiroshi Ikeda, Kanagawa (JP); Kentaro Ageishi, Kanagawa (JP); Yoshiro Yamashita, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 337 days.

(21) Appl. No.: 12/361,039

(22) Filed: Jan. 28, 2009

(65) Prior Publication Data

US 2009/0237479 A1 Sep. 24, 2009

(30) Foreign Application Priority Data

Mar. 24, 2008 (JP) ..... 2008-076471
Mar. 25, 2008 (JP) ..... 2008-078425

(51) Int. Cl.
*B41J 2/01* (2006.01)

(52) U.S. Cl. ..... 347/102; 347/101; 347/103; 347/104

(58) Field of Classification Search ..... 347/103
See application file for complete search history.

(56) References Cited

U.S. PATENT DOCUMENTS

| | | | | |
|---|---|---|---|---|
| 5,683,784 | A | 11/1997 | Nakao et al. | |
| 6,001,466 | A | 12/1999 | Noguchi et al. | |
| 6,136,382 | A | 10/2000 | Kamen et al. | |
| 6,257,716 | B1 | 7/2001 | Yanagawa et al. | |
| 7,261,408 | B2 * | 8/2007 | Otter | 347/102 |
| 7,270,408 | B2 * | 9/2007 | Odell et al. | 347/102 |
| 2001/0038409 | A1 | 11/2001 | Yanagawa et al. | |
| 2001/0055047 | A1 | 12/2001 | Ohsawa et al. | |
| 2001/0055728 | A1 | 12/2001 | Shibata | |
| 2003/0068571 | A1 | 4/2003 | Uehara et al. | |
| 2003/0165766 | A1 | 9/2003 | Zhang et al. | |
| 2005/0031348 | A1 | 2/2005 | Choi et al. | |
| 2005/0031384 | A1 | 2/2005 | Sohmiya et al. | |
| 2005/0110856 | A1 | 5/2005 | Mouri et al. | |

(Continued)

FOREIGN PATENT DOCUMENTS

CN 1911532 2/2007

(Continued)

OTHER PUBLICATIONS

USPTO Office Action, U.S. Appl. No. 12/326,248; May 18, 2010.

(Continued)

*Primary Examiner* — Laura Martin
*Assistant Examiner* — Jeremy Bishop
(74) *Attorney, Agent, or Firm* — Fildes & Outland, P.C.

(57) ABSTRACT

A recording apparatus including: an intermediate transfer member; an image forming composition layer formation unit that supplies an image forming composition to the intermediate transfer member, the image forming composition containing a curable material that cures upon application of an external stimulus; an ink application unit that applies ink to the image forming composition layer that has been formed on the intermediate transfer member; a transfer unit that transfers the image forming composition layer from the intermediate transfer member to a recording medium by contacting the image forming composition layer onto which the ink has been applied with the recording medium; and a first stimulus application unit that applies a stimulus to the image forming composition layer that cures the image forming composition layer, the stimulus being applied at least one of immediately before the image forming composition layer comes into contact with the recording medium, or during the contact.

8 Claims, 6 Drawing Sheets

U.S. PATENT DOCUMENTS

| | | | | |
|---|---|---|---|---|
| 2005/0259138 | A1 | 11/2005 | Doi | |
| 2006/0127651 | A1* | 6/2006 | Murata et al. | 428/195.1 |
| 2006/0158492 | A1 | 7/2006 | Odell et al. | |
| 2006/0164487 | A1 | 7/2006 | Kadomatsu et al. | |
| 2006/0238592 | A1* | 10/2006 | Kadomatsu et al. | 347/102 |
| 2006/0284951 | A1 | 12/2006 | Ikeda et al. | |
| 2006/0286315 | A1* | 12/2006 | Hashimoto et al. | 428/32.34 |
| 2007/0034152 | A1 | 2/2007 | Nakagawa et al. | |
| 2007/0120930 | A1* | 5/2007 | Domoto et al. | 347/102 |
| 2007/0176995 | A1* | 8/2007 | Kadomatsu et al. | 347/103 |
| 2007/0296790 | A1 | 12/2007 | Nakazawa et al. | |
| 2008/0045619 | A1 | 2/2008 | Jackson et al. | |
| 2008/0062241 | A1 | 3/2008 | Yamashita et al. | |
| 2009/0207226 | A1 | 8/2009 | Ikeda et al. | |
| 2009/0231406 | A1 | 9/2009 | Yamashita et al. | |
| 2009/0237479 | A1 | 9/2009 | Yamashita et al. | |
| 2009/0318591 | A1 | 12/2009 | Ageishi et al. | |
| 2009/0318613 | A1 | 12/2009 | Ageishi et al. | |

FOREIGN PATENT DOCUMENTS

| | | |
|---|---|---|
| CN | 101143513 | 3/2008 |
| JP | 5-229112 | 9/1993 |
| JP | 7-169100 | 7/1995 |
| JP | 08-090900 | 4/1996 |
| JP | 08-311784 | 11/1996 |
| JP | 9-263038 | 10/1997 |
| JP | 10-255331 | 9/1998 |
| JP | 11-188858 | 7/1999 |
| JP | 11-235866 | 8/1999 |
| JP | 11-259913 | 9/1999 |
| JP | 2000-052640 | 2/2000 |
| JP | 2000-94654 | 4/2000 |
| JP | 2000-198185 | 7/2000 |
| JP | 2000-343808 | 12/2000 |
| JP | 2001-10114 | 1/2001 |
| JP | 2001-212956 | 8/2001 |
| JP | 2001-315426 | 11/2001 |
| JP | 2002-321443 | 11/2002 |
| JP | 2002-370347 | 12/2002 |
| JP | 2003-57967 | 2/2003 |
| JP | 2003-080746 | 3/2003 |
| JP | 2003-080837 | 3/2003 |
| JP | 2003-246135 | 9/2003 |
| JP | 2004-009523 | 1/2004 |
| JP | 2004-148530 | 5/2004 |
| JP | 2005-170036 | 6/2005 |
| JP | 2006-193744 | 7/2006 |
| JP | 2007-015241 | 1/2007 |
| JP | 2007-58952 | 3/2007 |
| JP | 2007-152945 | 6/2007 |
| JP | 2007-168399 | 7/2007 |
| JP | 2007-230232 | 9/2007 |
| JP | 2008-68429 | 3/2008 |
| JP | 2008-100501 | 5/2008 |

OTHER PUBLICATIONS

USPTO Office Action, U.S. Appl. No. 12/326,248; Sep. 24, 2010.
USPTO Office Action, U.S. Appl. No. 12/326,248; Apr. 4, 2011.
USPTO Office Action, U.S. Appl. No. 12/325,595; Feb. 28, 2011.
USPTO Office Action, U.S. Appl. No. 12/325,595; Aug. 9, 2011.
USPTO Office Action, U.S. Appl. No. 12/326,287; May 18, 2011.
USPTO Office Action, U.S. Appl. No. 12/326,287; Oct. 27, 2011.
JPO Office Action, A.N. 2008-078425; dated Mar. 27, 2012 and English translation.

* cited by examiner

RECORDING APPARATUS

CROSS-REFERENCE TO RELATED APPLICATION

This application is based on and claims priority under 35 USC 119 from Japanese Patent Application Nos. 2008-076471 filed Mar. 24, 2008 and 2008-078425 filed Mar. 25, 2008.

BACKGROUND

1. Technical Field

The present invention relates to a recording apparatus.

2. Related Art

An inkjet recording system constitutes one method, of recording images, data, and the like with the use of ink. The principle of the inkjet recording system is such that an image is formed on a medium made of paper, cloth, a film or the like, by ejecting an ink in the form of a liquid or a melted solid through a nozzle, a slit, a porous film, or the like. Various methods of ejecting ink have been proposed, including a so-called charge-control system in which ink is ejected by means of an electrostatic attractive force; a so-called drop-on-demand system (pressure pulse system) in which ink is ejected by means of oscillating pressure in a piezoelectric element; a so-called thermal inkjet system in which ink is ejected by means of pressure generated by forming and growing air bubbles using a high temperature; and the like. By employing these systems, recorded materials portraying an image or data with extremely high fineness can be obtained.

In order to perform recording of an image or data with high fineness on various recording media including both permeable media and impermeable media, a method of recording an image onto an intermediate transfer member and then transferring the image onto a recording medium has been applied in recording systems using ink, including the aforementioned inkjet recording systems.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be explained with reference to the drawings. The same denotations are given to the members having the same function in all drawings, and overlapping explanations may be omitted.

First Exemplary Embodiment

Figure 1:
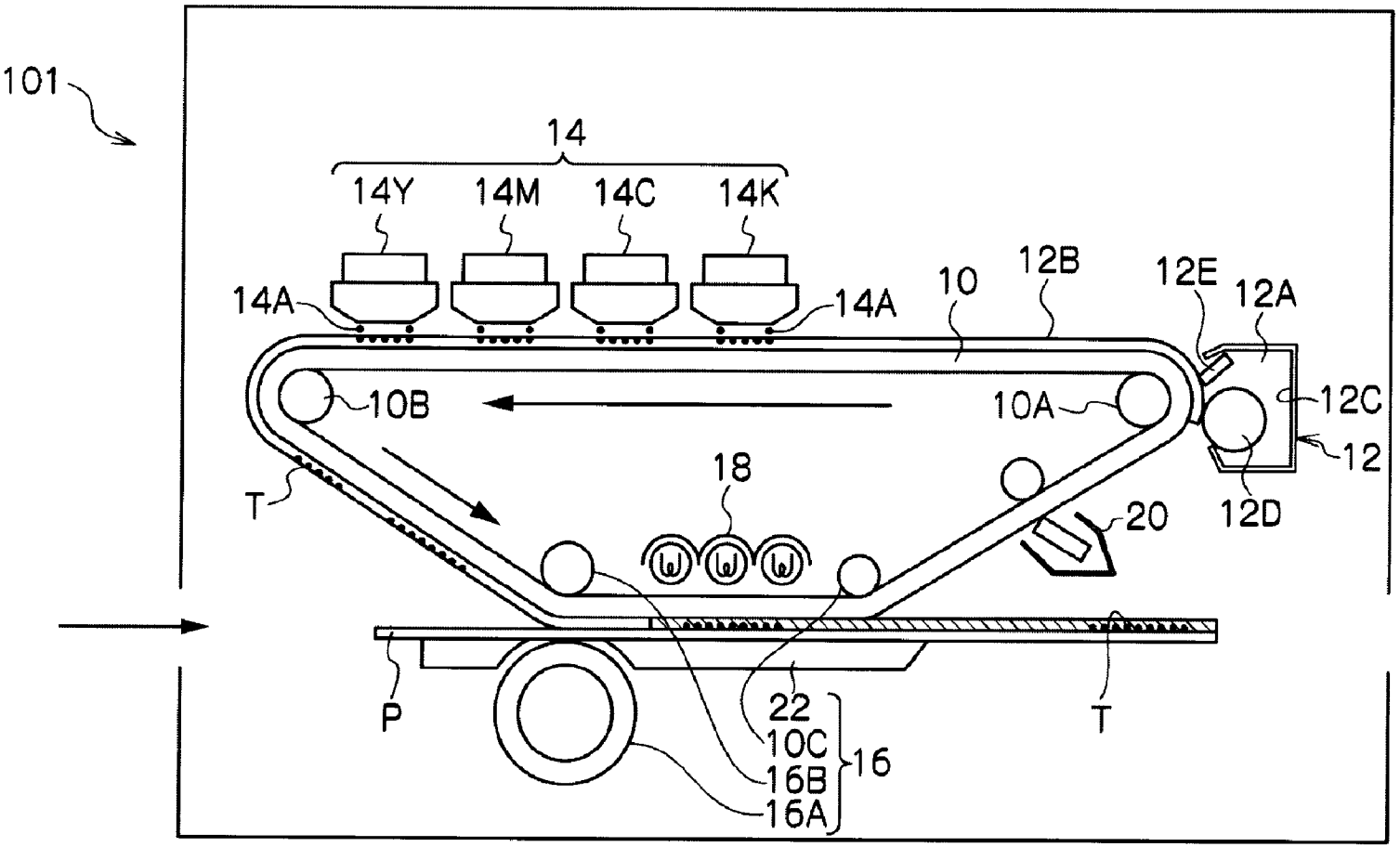
FIG. 1 is a configurational drawing showing a recording apparatus according to a first exemplary embodiment of the invention.

FIG. 1 is a configurational drawing showing a recording apparatus according to a first exemplary embodiment of the invention.

As shown in FIG. 1, for example, a recording apparatus 101 according to a first exemplary embodiment includes a composition supply unit 12 (image forming composition layer formation unit) that forms, onto an intermediate transfer belt 10, an image forming composition layer 12B by supplying an image forming composition 12A (details of the composition will be described later); an inkjet recording head 14 (ink application unit) that forms an image T by ejecting ink droplets 14A onto image forming composition layer 12B; a transfer unit 16 that transfers image forming composition layer 12B, on which image T is formed, onto a recording medium P by positioning recording medium P on intermediate transfer belt 10 and applying a pressure thereto; and a cleaning unit 20 that removes residues from image forming composition layer 12B or adhering materials (such as paper powder from recording medium P) from the surface of intermediate transfer belt 10, in this order around an intermediate transfer belt 10 in the form of an endless belt in a moving direction of intermediate transfer belt 10.

A stimulus application unit 18 is provided inside intermediate transfer belt 10. Stimulus application unit 18 applies a stimulus that cures image forming composition layer 12B that has been transferred onto recording medium P, when image forming composition layer 12B is in contact with recording medium P. Therefore, stimulus application unit 18 is provided at a position at which image forming composition layer 12B contacts recording medium P.

Intermediate transfer belt 10 is, for example, rotatably supported by three support rollers 10A to 10C and a pressure roller 16B (transfer unit 16) while a tension is applied from the inner side of the belt. Further, intermediate transfer belt 10 has a width (the length in an axial direction) equal to or wider than the width of recording medium P.

Intermediate transfer belt 10 may be formed from various kinds of materials known as a material used for the intermediate transfer belt, including resins (such as polyimide, polyamideimide, polyester, polyurethane, polyamide, polyether sulfone, and fluorine-based resins), rubbers (such as nitrile rubber, ethylene-propylene rubber, chloroprene rubber, isoprene rubber, styrene rubber, butadiene rubber, butyl rubber, chlorosulfonated polyethylene, urethane rubber, epichlorohydrin rubber, acrylic rubber, silicone rubber and fluororubber), metals such as stainless steel, or the like. Intermediate transfer belt 10 may have a single-layer structure or a laminated structure.

As mentioned above, in the present exemplary embodiment, stimulus application unit 18 is provided inside intermediate transfer belt 10. Therefore, a stimulus is applied to image forming composition layer 12B through intermediate transfer belt 10. Accordingly, intermediate transfer belt 10 preferably has a high degree of stimulus-transmittance so that a stimulus is efficiently applied to image forming composition layer 12B. Further, intermediate transfer belt 10 may have a high stimulus resistance.

For example, when stimulus application unit 18 is a UV ray irradiator, intermediate transfer belt 10 preferably has a high degree of UV-ray transmittance and UV-ray resistance. Specifically, intermediate transfer belt 10 preferably has a UV-ray transmittance of 70% or more. When the UV-ray transmittance is within the above range, UV-ray energy used for curing reaction of image forming composition layer 12B may be efficiently supplied to image forming composition layer 12B, and generation of heat due to absorption of UV rays by intermediate transfer belt 10 may be suppressed.

Materials that may be used for intermediate transfer belt 10 include a film of FTFE (ethylene-tetrafluoroethylene copolymer), polyimide, polyolefin or the like.

In the present exemplary embodiment, the surface free energy of the surface of intermediate transfer belt 10 that contacts image forming composition layer 12B ($\gamma_T$) is preferably lower. In particular, the above surface free energy ($\gamma_T$) is preferably less than the surface free energy of the surface of recording medium P that contacts image forming composition layer 12B ($\gamma_P$), and further preferably satisfies the following formula:

$$\gamma_P-\gamma_T>10$$

The value of the surface free energy may be measured by a contact angle meter, CAM-200 (trade name) manufactured by KSV Instruments, using a computer program employing a Zisman method installed therein.

A release layer may be provided on the surface of intermediate transfer belt 10 in order to decrease the above surface free energy ($\gamma_T$).

Materials that can be used for the release layer include fluorine-based resin materials such as fluorine resins, fluorine-modified urethane/silicone resins, copolymerized fluorine rubbers, fluorine resin-copolymerized vinyl ether, PFA (tetrafluoroethylene perfluoro alkoxy resins), powder coatings or resin tubes of FEP (tetrafluoroethylene-hexafluoropropylene copolymer) or the like, PTFE-dispersed urethane coatings, PTFE (polytetrafluoroethylene) tubes, PVDF (polyvinylidenefluoride), and PHV (polytetrafluorovinylidene) resin materials.

Among the above materials, materials having a high degree of stimulus transmittance are preferable. When materials having a low degree of stimulus transmittance are used, the release layer preferably has a small thickness.

The surface of intermediate transfer belt 10 may be smooth or with irregularities. Since the image that has contacted the surface of intermediate transfer belt 10 is transferred onto a recording medium, recorded materials with high gloss may be obtained when the surface of intermediate transfer belt 10 is smooth, and recorded materials with rough texture may be obtained when irregularities are formed on the surface of intermediate transfer belt 10.

Composition supply unit 12 includes, for example, a supply roller 12D that supplies image forming composition 12A onto intermediate transfer belt 10, and a blade 12E that regulates the thickness of image forming composition layer 12B formed from image forming composition 12A, in a housing 12C that stores image forming composition 12A.

Composition supply unit 12 may have supply roller 12D that continuously contacts intermediate transfer belt 10, or a gap may be provided therebetween. Further, composition supply unit 12 may have a configuration in which image forming composition 12A is supplied from an independent supply system (not shown) to housing 12C in order to supply image forming composition 12A without intermission. Details of image forming composition 12A will be described later.

The configuration of composition supply unit 12 is not limited to the above and known supply systems employing die coater coating, bar coater coating, spray coating, inkjet coating, air-knife coating, blade coating, roll coating, and the like, may also be used.

Inkjet recording head 14 includes, for example, recording heads for each color including a recording head 14K for ejecting an black ink, a recording head 14C for ejecting a cyan ink, a recording head 14M for ejecting a magenta ink, and a recording head 14Y for ejecting a yellow ink, in the order from the upstream side in a moving direction of intermediate transfer belt 10. The structure of recording head 14 is not limited to the above configuration, and may not include all of the recording heads 14K, 14C, 14M and 14Y.

Each recording head 14 is preferably positioned on a flat section of the surface of rotatably supported intermediate transfer belt 10, with a gap between the surface of intermediate transfer belt 10 and recording head 14 of from 0.7 to 1.5 mm.

Each recording head 14 is preferably a line-type inkjet recording head having a width equal to or wider than the width of recording medium P, but a conventional scan-type inkjet recording head may also be used.

The method of ejecting ink from each recording head 14 may be any method such as a piezo-electric-element-driving method, a heater-element-driving method, or the like.

Transfer unit 16 includes, for example, pressure rollers 16A and 16B, a support roller 10C, and a support 22 positioned in the following manner.

Specifically, pressure roller 16B and support roller 10C form a flat section of intermediate transfer belt 10. Support 22 is provided on the side opposite to pressure roller 16B via the flat section of intermediate transfer belt 10. Pressure roller 16A is provided on the side opposite to pressure roller 16B via intermediate transfer belt 10 and contacts recording medium P through an opening (not shown) provided in support 22.

Accordingly, image forming composition layer 12B contacts both of intermediate transfer belt 10 and recording medium P at a region ranging from a point at which intermediate transfer belt 10 and recording medium P are nipped by pressure rollers 16A and 16B (hereinafter, referred to as "contact start position" sometimes) to a point at which intermediate transfer belt 10 and recording medium P are nipped by support roller 10C and support 22 (hereinafter, referred to as "release position" sometimes).

Stimulus application unit 18 is provided inside of intermediate transfer belt 10, and applies a stimulus to image forming composition layer 12B in contact with both of intermediate transfer belt 10 and recording medium P through intermediate transfer belt 10.

The type of stimulus application unit 18 may be selected according to the type of curable material contained in image forming composition 12A. For example, when the curable material is cured upon irradiation with UV rays, a UV-ray irradiator is used as stimulus application unit 18 that irradiates image forming composition 12A (or image forming composition layer 12B formed from image forming composition 12A) with UV rays. When the curable material is cured upon irradiation with electron beams, an electron-beam irradiator is used as stimulus application unit 18 that irradiates image forming composition 12A (or image forming composition layer 12B formed from image forming composition 12A) with electron beams. When the curable material is cured upon application of heat, a heater is used as stimulus application unit 18 that applies heat to image forming composition 12A (or image forming composition layer 12B formed from image forming composition 12A).

The UV-ray irradiator may be, for example, a metal halide lamp, a high-pressure mercury lamp, an ultra high-pressure mercury lamp, a deep UV-ray lamp, a lamp that excites a mercury lamp externally with microwaves with no electrode, UV laser, a xenon lamp, and a UV-LED.

The conditions for irradiation with UV rays are not specifically limited, and may be selected depending on the type of curable material, thickness of image forming composition layer 12B, or the like. For example, when a metal halide lamp is used, irradiation with UV rays may be conducted with an integrated light intensity of from 10 to 1000 mJ/cm$^2$.

The electron-beam irradiator may be, for example, a scan-type or curtain-type irradiator. The curtain-type electron-beam irradiator is a device that draws out thermoelectrons generated at a filament by a grid in a vacuum chamber, accelerates it to form an electron current by a high voltage (for example, 70 kV to 300 kV), and discharge the electron current into the atmosphere through a window foil. The wavelength of the electron beams is generally shorter than 1 nm, and the energy of the electron beams can be up to several MeVs, but the electron beams having a wavelength in an order of pm and energy of several ten to several hundred keV are normally used.

The conditions for irradiation with electron beams are not specifically limited, and may be selected depending on the type of curable material, thickness of image forming composition layer 12B, or the like. For example, the irradiation may be conducted with an electron-beam quantity of from 5 to 100 kGy levels.

The heater may be, for example, a halogen lamp, a ceramic heater, a Nichrome-wire heater, a microwave heater, an infrared-ray lamp, or the like. A heating device employing an electromagnetic induction method is also applicable.

The conditions for applying heat are not specifically limited, and may be selected depending on the type of curable material, thickness of image forming composition layer 12B, or the like. For example, the application of heat may be conducted at a temperature of 200° C. for 5 minutes, in the atmosphere.

Recording medium P may be either a permeable medium (for example, plain paper, coated paper or the like) or a non-permeable medium (for example, art paper, resin film or the like). However, recording medium P is not restricted thereto and may be selected from other industrial products, such as a semiconductor substrate.

In the following, a process of recording an image using recording apparatus 101 according to the present exemplary embodiment will be explained.

In recording apparatus 101 according to the present exemplary embodiment, intermediate transfer belt 10 is driven to rotate, and image forming composition 12A is supplied onto the surface of intermediate transfer belt 10 from composition supply unit 12 to form image forming composition layer 12B.

The thickness of image recording composition layer 12B (average thickness) is not specifically restricted, but preferably in the range of from 1 μm to 50 μm, more preferably in the range of from 3 μm to 20 μm, from the viewpoint of achieving both image formation properties and transfer properties.

Further, for example, when image forming composition layer 12B has a thickness through which ink droplets 14A do not reach the bottom of image forming composition layer 12B, the portion in which ink droplets 14A exist in image forming composition layer 12B are not exposed after transferring layer 12B onto recording medium P. In this case, the region in which ink droplets 14A do not exist may serve as a protective layer after being cured.

Next, ink droplets 14A ejected from inkjet recording head 14 are applied to image forming composition layer 12B that has been formed onto intermediate transfer drum 10. Inkjet recording head 14 applies ink droplets 14A to a predetermined position in image forming composition layer 12B in accordance with the image information.

Image forming composition layer 12B preferably has an ability of fixing a colorant in ink upon application of the ink.

The application of ink droplets 14A is performed by inkjet recording head 14 on a flat section of intermediate transfer belt 10 that is rotatably supported with a tension. Therefore, ink droplets 14A are applied onto image forming composition layer 12B at a portion of intermediate transfer belt 10 which is not bended.

Next, recording medium P and intermediate transfer belt 10 are nipped by pressure rollers 16A and 16B and a pressure is applied thereto. At this time, image forming composition layer 12B formed on intermediate transfer belt 10 contacts recording medium P (contact start position). Image forming composition layer 12B remains in contact with both of intermediate transfer belt 10 and recording medium P until it reaches a position at which image forming composition layer 12B is nipped by support roller 10C and support 22 (release position).

The pressure applied by pressure rollers 16A and 16B is preferably in the range of from 0.001 MPa to 2 MPa, more preferably in the range of from 0.001 MPa to 0.5 MPa, from the viewpoint of improving transfer efficiency and suppressing image disorders.

Next, a stimulus is applied to image forming composition layer 12B that is in contact with intermediate transfer belt 10 and recording medium P, by stimulus application unit 18 through intermediate transfer belt 10, thereby curing image forming composition layer 12B. Specifically, the application of stimulus is performed after image forming composition layer 12B has contacted recording medium P (after passing through the contact start position), and is completed before image forming composition layer 12B is released from intermediate transfer belt 10 (before reaching the release position).

The amount of stimulus to be applied may be determined so that image forming composition layer 12B is readily released from intermediate transfer belt 10. Specifically, when the stimulus is UV rays, the integrated light intensity is preferably in the range of from 10 mJ/cm$^2$ to 1,000 mJ/cm$^2$, from the viewpoint of improving transfer efficiency and suppressing heat generation.

Next, image forming composition layer 12B is released from intermediate transfer belt 10 at the release position, and a curable resin layer (image layer) including an image T formed from ink droplets 14A is formed on recording medium P.

Finally, residuals or adhering matters remaining on the surface of intermediate transfer belt 10 after image forming composition layer 12B has been transferred to recording medium P are removed by cleaning unit 20, and the above-described image formation process is performed again by supplying image forming composition 12A onto intermediate transfer belt 10 to form image forming composition layer 12B.

In this way, image formation in recording apparatus 101 according to the present exemplary embodiment is conducted.

In the recording apparatus of the present exemplary embodiment, since a stimulus is applied to image forming composition layer 12B formed on intermediate transfer belt 10 after image forming composition layer 12B has passed the contact start position, image forming composition layer 12B is in a liquid state when it contacts recording medium P. Therefore, image forming composition layer 12B may adhere to recording medium P in a favorable manner.

Further, by the time image forming composition layer 12B reaches the release position, curing reaction of image forming composition layer 12B has progressed to increase its internal cohesion force. Therefore, liquid separation at the time of releasing (a phenomenon that image forming composition layer 12B remains on both intermediate transfer belt 10 and recording medium P upon releasing) may be suppressed. Further, the viscosity of image forming composition layer 12B is lowered due to curing reaction to improve release properties thereof.

Moreover, since curing reaction of image forming composition layer 12B is promoted by applying a stimulus when image forming composition layer 12B is adhered to recording medium P in a favorable manner, image forming composition layer 12B and recording medium P are tightly adhered to each other and image forming composition layer 12B forms a film, thereby preventing image forming composition layer 12B from remaining on intermediate transfer belt 10.

For the reasons as mentioned above, transfer efficiency of intermediate transfer belt 10 to recording medium P may be improved.

In the present exemplary embodiment, as mentioned above, liquid separation at the time of releasing may be suppressed, and transfer efficiency may be improved even a transfer process is performed at high speed.

Further, even when a permeable recording medium is used, permeation of image forming composition layer 12B into recording medium P may be suppressed by regulating the position of stimulus application unit 18 or conditions for stimulus application in order to shorten the time period between the point at which image forming composition layer 12B passes the contact start position and the point at which image forming composition layer 12B is cured. Therefore, image formation may be performed with an image quality that is as high as that achieved in cases of using a non-permeable recording medium.

As mentioned above, in the present exemplary embodiment, the surface free energy of the surface of intermediate transfer belt 10 that contacts image forming composition layer 12B ($\gamma_T$) is preferably less than the surface free energy of the surface of recording medium P that contacts image forming composition layer 12B ($\gamma_P$). In this case, adhesion of image forming composition layer 12B to recording medium P may be increased and the releasing of image forming composition layer 12B from intermediate transfer belt 10 may be facilitated. Therefore, transfer efficiency of image forming composition layer 12B from intermediate transfer belt 10 to recording medium P may be further improved.

Further, in the present exemplary embodiment, since stimulus application unit 18 is inside of intermediate transfer belt 10 and a stimulus is applied to image forming composition layer 12B through intermediate transfer belt 10, the amount of applied stimulus at the portion of image forming composition layer 12B that is in contact with intermediate transfer belt 10 is larger than that at the portion of image forming composition layer 12B that is in contact with recording medium P. Accordingly, curing reaction is less promoted at the portion at which image forming composition layer 12B contacts recording medium P, and thus the adhesion of image forming composition layer 12B to recording medium P is high. On the other hand, curing reaction is more promoted at the portion at which image forming composition layer 12B contacts intermediate transfer belt 10, and thus the adhesion of image forming composition layer 12B to intermediate transfer belt 10 is less. The larger the difference between the adhesion of image forming composition layer 12B to recording medium P and the adhesion of image forming composition layer 12B to intermediate transfer belt 10 is, the larger the difference between the releasability of image forming composition layer 12 from intermediate transfer belt 10 and the releasability of image forming composition layer 12 from recording medium, namely, image forming composition layer 12B is more likely to be released from intermediate transfer belt 10 but less likely to be released from recording medium P.

Moreover, in the present exemplary embodiment, ink droplets 14A are applied onto image forming composition layer 12B on the side that does not contacts intermediate transfer belt 10. Therefore, if image forming composition layer 12B has a thickness through which ink droplets 14A do not reach the bottom of image forming composition layer 12B, ink droplets 14A exist on the side of image forming composition layer 12 that does not contact intermediate transfer belt 10. Namely, since the side of image forming composition layer 12B that contacts intermediate transfer layer 10 is covered with image forming composition 12A, image forming composition layer 12B may be cured by a stimulus applied through intermediate transfer belt 10 without interruption of ink droplets 14A. Accordingly, the side of image forming composition layer 12A that contacts intermediate transfer belt 10 may be uniformly cured no matter whether an image is formed or not. On the other hand, in an embodiment in which ink containing a curable material is applied directly onto an intermediate transfer belt, the amount of stimulus may differ depending on the type or color of the ink, and the necessary amount of stimulus may be larger than that used in the present exemplary embodiment. In view of the foregoing, in the present exemplary embodiment, irregularities in the curing degree of image forming composition layer 12B caused by an image formed thereon may be more reduced, liquid separation upon releasing may be more suppressed, and transfer efficiency may be more improved.

In the present exemplary embodiment, as mentioned above, a stimulus is applied to image forming composition layer 12B through intermediate transfer belt 10. Therefore, application of stimulus may be conducted while image forming composition layer 12B is in contact with intermediate transfer belt 10 without restricting the configuration of apparatus (for example, if a stimulus is applied from the outside of intermediate transfer belt 10, support 22 and recording medium P need to be formed from a stimulus-transmissive material in order that a stimulus is applied while image forming composition layer 12B is in contact with intermediate transfer belt 10).

Further, since a stimulus application unit 18 is inside of intermediate transfer belt 10, the recording apparatus of the present exemplary embodiment may be more space-saving compared to a recording apparatus having stimulus application unit 18 outside intermediate transfer belt 10.

Moreover, as mentioned above, since ink droplets 14A are applied onto image forming composition layer 12B, a uniform image layer (image forming composition layer 12B onto which ink droplets 14A are applied) may be formed on intermediate transfer belt 10 irrespective of the configuration of an image. Therefore, image defects may be suppressed since a pressure is applied uniformly onto an image portion and non-image portion, without locally concentrating onto an image portion or the like.

In the present exemplary embodiment, image forming composition 12A contained in image forming composition layer 12B onto which ink droplets 14A have been applied is cured. Therefore, images may be fixed without the need of including a curable material in ink droplets 14A. Accordingly, ink ejection may be conducted in a more stable manner by suppressing nozzle clogging in inkjet recording head 14 by using an ink containing no curable material, no matter if the ink is oily or aqueous.

In the above explanation, application of a stimulus is initiated after image forming composition layer 12B has passed the contact start position and completed before image forming composition layer 12B reaches the release position. However, the present exemplary embodiment is not limited to this configuration.

For example, the stimulus application may start when image forming composition layer 12B passes through the contact start position, or may start before image forming composition layer 12B passes through the contact start position. Further, the stimulus application may be completed when image forming composition layer 12B reaches the release position, or may be completed after image forming composition layer 12B has reached the release position. Additionally, the stimulus application may stop and start again during the time period between the initiation and the completion of stimulus application.

In the above explanation, as mentioned above, stimulus application unit 18 is provided inside of intermediate transfer belt 10 to apply a stimulus onto image forming composition layer 12B through intermediate transfer belt 10. However, the present exemplary embodiment is not limited to this configuration. For example, stimulus application unit 18 may be provided outside the intermediate transfer belt 10 to apply a stimulus directly (or through support 22 or recording medium P) onto image forming composition layer 12B.

The present exemplary embodiment may also have a configuration in which the main body of stimulus application unit 18 is outside the intermediate transfer belt 10, while a stimulus is applied onto image forming composition layer 12B through intermediate transfer belt 10. For example, when stimulus application unit 18 is a UV-ray irradiator, the main body of the irradiator may be positioned outside the intermediate transfer belt 10 while UV rays are introduced inside of intermediate transfer belt 10 by means of optical fiber or the like to irradiate image forming composition layer 12B with UV rays through intermediate transfer belt 10.

In the above explanation, a full-color image is formed by selectively ejecting ink droplets 14A of black, yellow, magenta and cyan onto recording medium P. However, the present exemplary embodiment is not limited to the recording of characters or images. For example, the recording apparatus of the present exemplary embodiment may be used for applications such as droplet application (jetting) devices in general for industrial use, method of forming an image by transfer using printing plates, method of forming an image by screen printing, or the like.

Second Exemplary Embodiment

Figure 2:
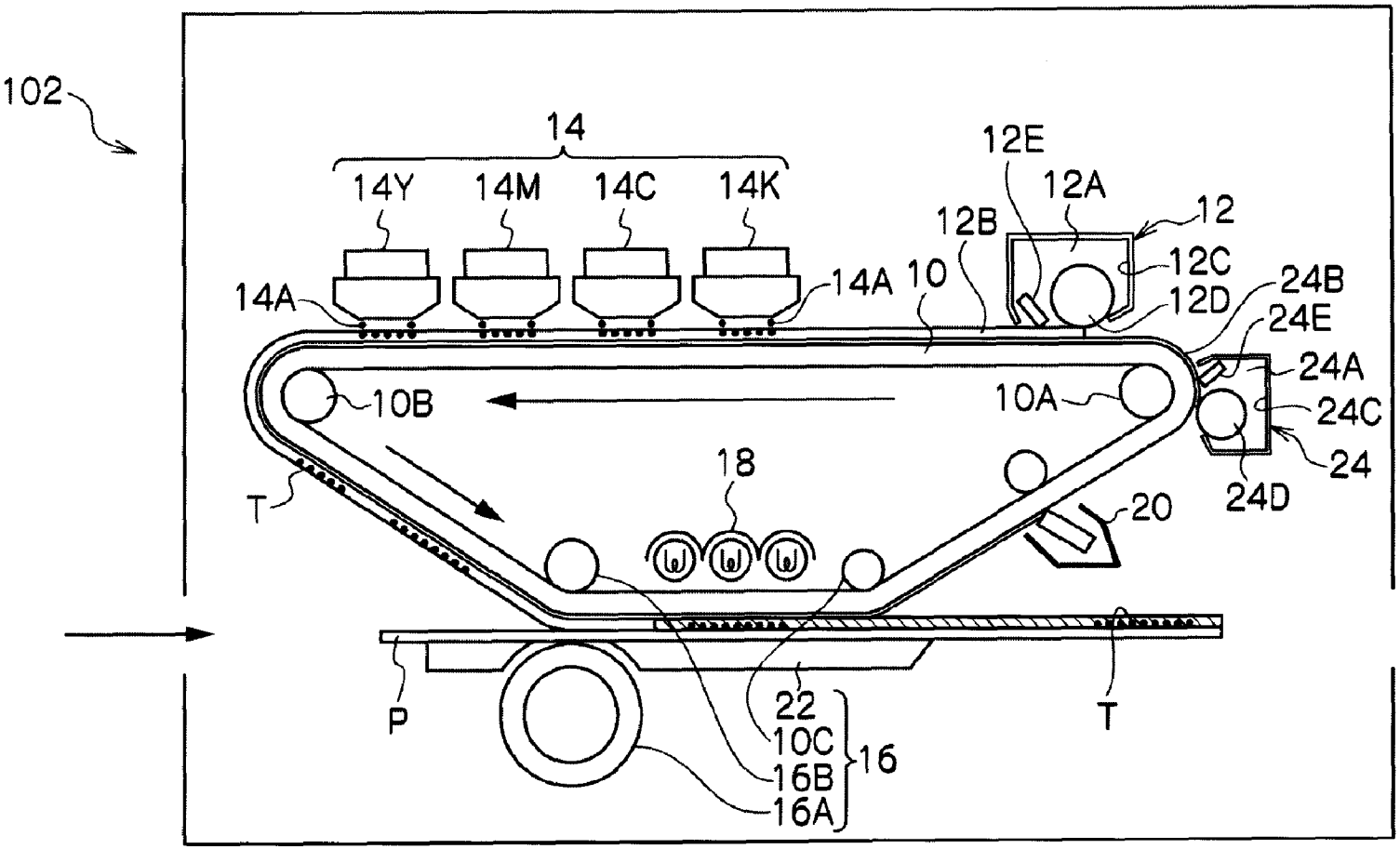
FIG. 2 is a configurational drawing showing a recording apparatus according to a second exemplary embodiment of the invention.

FIG. 2 is a configurational drawing showing a second exemplary embodiment of the present invention.

As shown in FIG. 2, a recording apparatus 102 further includes a release agent application unit 24 that forms a release agent layer 24B.

Release agent application unit 24 is provided upstream of composition supply unit 12 in a moving direction of intermediate transfer belt 10. Namely, release agent application unit 24 is positioned between composition supply unit 12 and cleaning unit 20.

Release agent application unit 24 includes, for example, a supply roller 24D that supplies a release agent 24A to intermediate transfer belt 10 and a blade 24E that regulates the thickness of release agent layer 24B formed from the supplied release agent 24A, in a housing 24C that stores release agent 24A. Release agent application unit 24 may also optionally include a heater (not shown) for heating release agent 24A to melt.

Release agent application unit 24 may be positioned so that supply roller 24D constantly contacts intermediate transfer belt 10, or a gap may be provided between supply roller 24D and intermediate transfer belt 10.

The configuration of release agent supply unit 24 is not limited to the above and known supply systems employing bar coater coating, spray coating, inkjet coating, air-knife coating, blade coating, roll coating, or the like, may also be used.

Examples of release agent 24A include silicone oil, fluorine oil, hydrocarbons, polyalkylene glycol, fatty acid ester, phenyl ether, phosphoric acid ester, or the like. Among these, silicone oil, fluorine oil and polyalkylene glycol are preferable.

Examples of the silicone oil include straight silicone oil and modified silicone oil.

Examples of the straight silicone oil include dimethyl silicone oil and methyl hydrogen silicone oil.

Examples of the modified silicone oil include methyl styryl-modified oil, alkyl-modified oil, higher fatty acid ester-modified oil, fluorine-modified oil, and amino-modified oil.

Examples of the polyalkylene glycol include polyethylene glycol, polypropylene glycol, ethylene oxide-propylene oxide copolymers, and polybutylene glycol. Among these, polypropylene glycol and polyethylene glycol are preferable.

In recording apparatus 102, release agent supply unit 24 forms release agent layer 24B by applying release agent 24A onto the surface of intermediate transfer belt 10, before image forming composition 12A is supplied to the surface of intermediate transfer belt 10 by composition supply unit 12.

Namely, image forming composition 12A is supplied to release agent layer 24B that has been formed on intermediate transfer belt 10.

After releasing image forming composition layer 12B from intermediate transfer belt 10, release agent layer 24B remaining on the surface of intermediate transfer belt 10 is removed by cleaning unit 20, and release agent 24A is applied again onto intermediate transfer belt 10 by release agent application unit 24 to repeat an image formation process.

The same explanations given in the first exemplary embodiment may apply to other features than the above of this exemplary embodiment.

In the recording apparatus of the present exemplary embodiment, release agent layer 24B is formed by applying release agent 24A onto the surface of intermediate transfer belt 10. In this way, the surface free energy of the surface of intermediate transfer belt 10 that contacts image forming composition layer 12B ($\gamma_T$) can be readily decreased. Therefore, the transfer efficiency of image forming composition layer 12B onto recording medium P from intermediate transfer belt 10 may be further improved.

Further, by employing the above configuration, the surface of intermediate transfer belt 10 may be less susceptible to temporal change to increase temporal stability thereof, and cleaning properties thereof may also be improved.

In the present exemplary embodiment, "surface free energy ($\gamma_T$)" refers to a surface free energy of the surface of intermediate transfer belt 10 onto which release agent layer 24B, which surface contacts image forming composition layer 12B. Therefore, even if the surface free energy of intermediate transfer belt 10 itself is high, it is also a preferable embodiment as long as the surface free energy ($\gamma_T$), which is a surface free energy of the surface of intermediate transfer belt 10 onto which release agent layer 24B, is at low level.

Third Exemplary Embodiment

Figure 3:
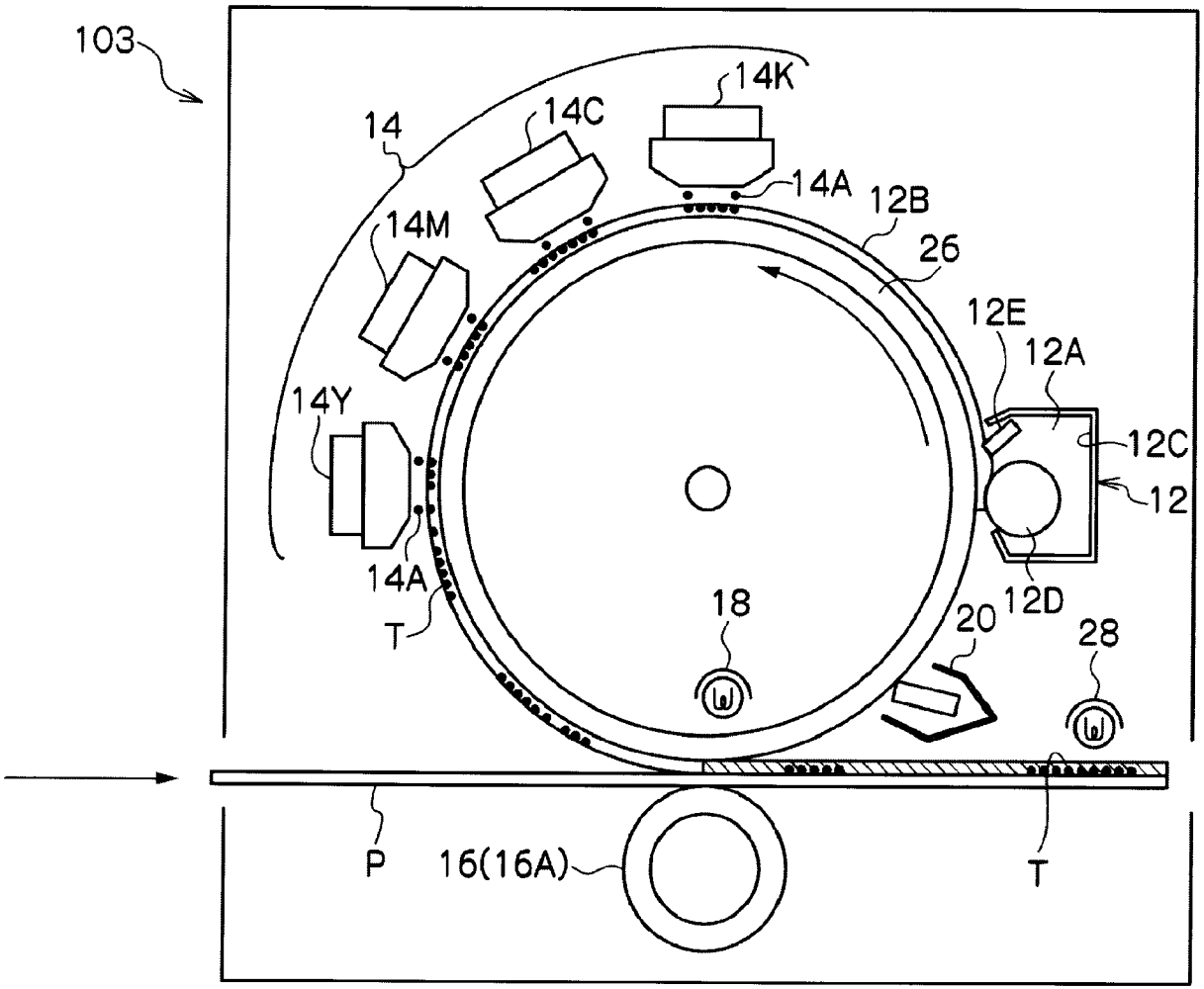
FIG. 3 is a configurational drawing showing a recording apparatus according to a third exemplary embodiment of the invention.

FIG. 3 shows a configurational drawing showing a recording apparatus according to a third exemplary embodiment.

A recording apparatus 103 include, as shown in FIG. 3, an intermediate transfer drum 26 in place of intermediate transfer belt 10 in recording apparatus 101 according to the first exemplary embodiment. In the present exemplary embodiment, a stimulus application unit 28 may be disposed downstream of stimulus application 18 in a moving direction of recording medium P in order to conduct further curing and fixation of image forming composition layer 12B that has been transferred onto recording medium P.

Intermediate transfer drum 26 may have a single-layer structure or a multi-layer structure. One example of the multiple-layer structure includes a cylindrical substrate and a surface layer formed on the surface of the substrate. Intermediate transfer drum 26 may have a width that is equal to or wider than the width of recording medium P (in an axial direction).

Materials for the cylindrical substrate of intermediate transfer drum 26 include aluminum, stainless steel (SUS), cupper and glass.

Materials for the surface layer of intermediate transfer drum 26 include resins (such as polyimide, polyamideimide, polyester, polyurethane, polyamide, polyether sulfone, and fluorine-based resins), rubbers (such as nitrile rubber, ethylene-propylene rubber, chloroprene rubber, isoprene rubber, styrene rubber, butadiene rubber, butyl rubber, chlorosulfonated polyethylene, urethane rubber, epichlorohydrin rubber, acrylic rubber, silicone rubber and fluororubber). The surface layer may have a single-layer structure or a multi-layer structure.

Since stimulus application unit 18 is inside of intermediate transfer drum 26, as shown in the first exemplary embodiment, the stimulus is applied to image forming composition layer 12B through intermediate transfer drum 26. Therefore, from the viewpoint of efficiently applying the stimulus to image forming composition layer 12B, intermediate transfer drum 26 preferably has a high degree of stimulus-transmittance. In view of durability, intermediate transfer drum 26 preferably has a high degree of stimulus-resistance.

For example, if stimulus application unit 18 is a UV irradiator, UV transmittance of intermediate transfer drum 26 is preferably 70% or more from the viewpoint of improving energy efficiency and suppressing heat generation. In this regard, intermediate transfer drum 26 is preferably formed from silica glass, or from a cylindrical substrate of silica glass having a surface layer formed from a fluorocarbon resin or a silicone resin on the substrate.

As mentioned in the above exemplary embodiments, the surface free energy of the surface of intermediate transfer drum 26 that contacts image forming composition layer 12B ($\gamma_T$) is preferably low, more preferably less than the surface free energy of the surface of recording medium P that contacts image forming composition layer 12B ($\gamma_P$), and further preferably satisfies the following formula:

$$\gamma_P-\gamma_T>10$$

From the viewpoint of reducing the above surface free energy ($\gamma_T$), preferable materials for the surface layer of intermediate transfer drum 26 include those used for the surface release agent layer of intermediate transfer belt 10 as mentioned in the first exemplary embodiment.

Each inkjet recording head 14 may be positioned with a distance between the surface of intermediate transfer drum 26 and a nozzle face of inkjet recording head 14 of about 0.3 mm to 0.7 mm. Further, each inkjet recording head 14 may be positioned such that the longer direction of inkjet recording head 14 intersects with the rotation direction of intermediate transfer drum 26 (preferably at a right angle).

Transfer unit 16 may include a pressure roller 16A that is positioned so as to be pressed against intermediate transfer drum 26.

Stimulus application unit 28 may apply a similar kind of stimulus to that applied by stimulus application unit 18, and a similar kind of device may be used for stimulus application unit 28.

In recording apparatus 103 according to the present exemplary embodiment, ink droplets 14 are applied from inkjet recording head 14 onto image forming composition layer 12B that has been formed on intermediate transfer drum 26.

The application of ink droplets 14 by inkjet recording head 14 is performed over intermediate transfer drum 26, which is made from a rigid material. Therefore, ink droplets 14 are applied onto image forming composition layer 12B on the surface of intermediate transfer drum 16 that has no bending.

Next, image forming composition layer 12B onto which ink droplets 14 have been applied is brought into contact with recording medium P with a pressure applied by pressure roller 16A in transfer unit 16. Then, at a position where image forming composition layer 12B is in contact with recording medium P (contact start position), stimulus application unit 18 starts application of a stimulus to image forming composition layer 12B that is in contact with both intermediate transfer drum 26 and recording medium P. Thereafter, curable 12B is released from intermediate transfer drum 26, and the application of a stimulus to image forming composition layer 12B is completed after the releasing.

Subsequently, image forming composition layer 12B that has been subjected to stimulus application by stimulus application unit 18 is subjected to further stimulus application by stimulus application unit 28, and cured to fix to recording medium P.

Other features of the present exemplary embodiment may be similar to those described in the first exemplary embodiment.

In the present exemplary embodiment, intermediate transfer drum 26 is used as an intermediate transfer member. In this way, as well as the first exemplary embodiment, transfer efficiency of image forming composition layer 12B onto recording medium P from intermediate transfer drum 26 may be improved. Reasons for this are similar to those mentioned in the first exemplary embodiment employing intermediate transfer belt 10.

In the present exemplary embodiment, as mentioned above, application of a stimulus is initiated when image forming composition layer 12B is at the contact start position and is completed after image forming composition layer 12B has passed the release position. However, the present exemplary embodiment is not limited to this process and other processes as mentioned in the first exemplary embodiment are also applicable.

In the present exemplary embodiment, as mentioned above, a stimulus is applied to image forming composition layer 12B when image forming composition layer 12B is in contact with recording medium P, and after image forming composition layer 12B has contacted recording medium P. However, the present exemplary embodiment is not limited to this process, as long as a stimulus is applied to image forming composition layer 12B immediately before image forming composition layer 12B contacts recording medium P or when image forming composition layer 12B is in contact with recording medium P.

Stimulus application unit 28 may be used in the present exemplary embodiment, or may be omitted.

In the present exemplary embodiment, stimulus application unit 18 is inside of intermediate transfer drum 26 and a stimulus is applied to image forming composition layer 12B through intermediate transfer drum 26. However, the present exemplary embodiment is not limited to the above configuration. Other configurations that are applicable are similar to those mentioned in the first exemplary embodiment.

Fourth Exemplary Embodiment

Figure 4:
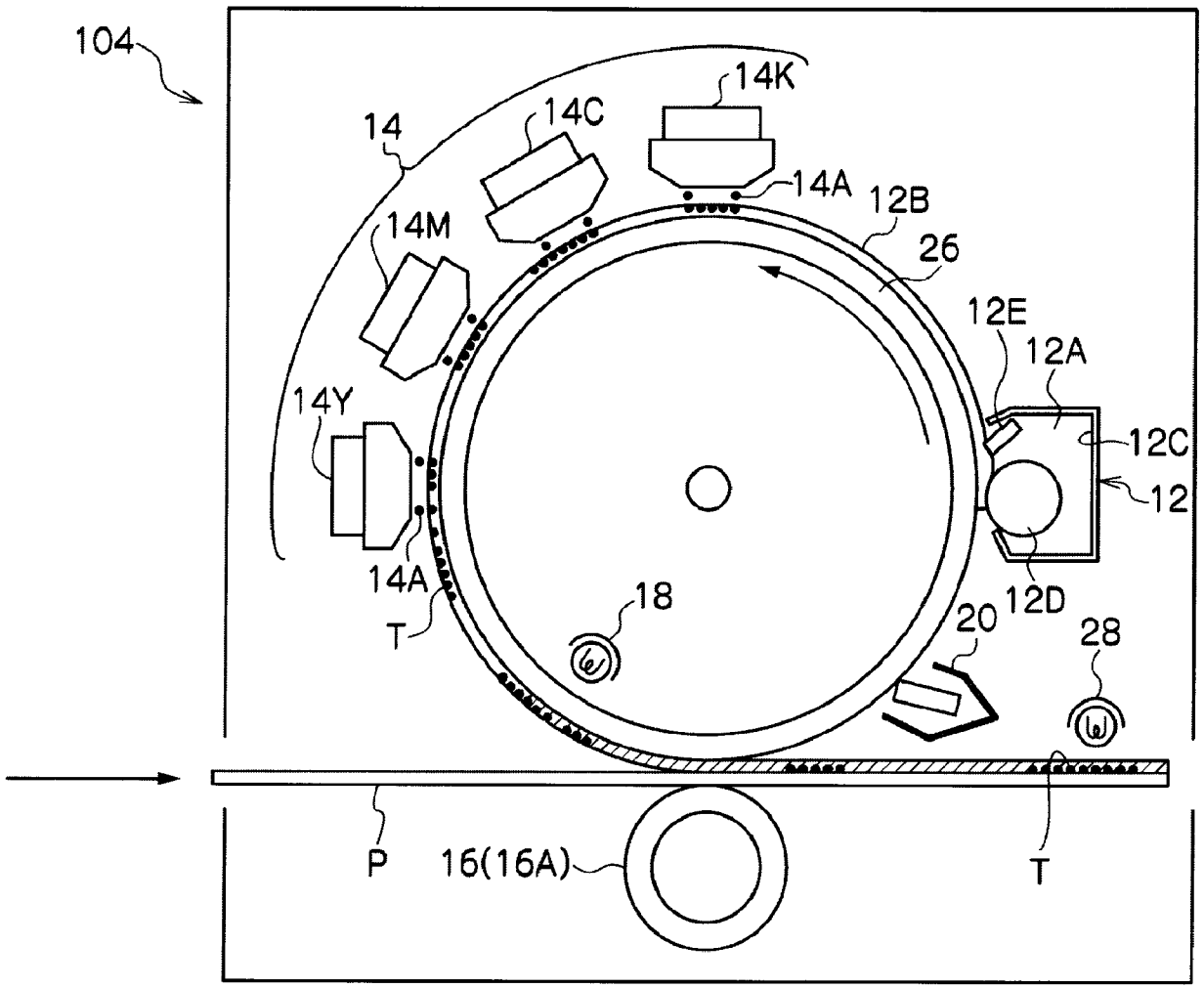
FIG. 4 is a configurational drawing showing a recording apparatus according to a fourth exemplary embodiment of the invention.

FIG. 4 is a configurational drawing showing a recording apparatus according to a fourth exemplary embodiment.

In a recording apparatus 104, as shown in FIG. 4, stimulus application unit 18 in the third exemplary embodiment is positioned so that a stimulus is applied to image forming composition layer 12B only immediately before curable 12B contacts recording medium P. Specifically, stimulus application unit 18 in this exemplary embodiment is positioned upstream of a point at which image forming composition layer 12B on intermediate transfer drum 26 contacts recording medium P by means of pressure roller 16A (contact start position), in a rotation direction of intermediate drum 26. In recording apparatus 104 according to this exemplary embodiment, for example, a cationic curable material is used as a curable material contained in image forming composition 12A.

The recitation "a stimulus is applied to image forming composition layer 12B immediately before curable 12B contacts recording medium P" refers to a situation that the stimulus is applied to image forming composition layer 12B in such a manner that image forming composition layer 12B maintains its liquidity at the contact start position (a position at which image forming composition layer 12B contacts recording medium P). Therefore, when image forming composition layer 12B is completely cured to lose its liquidity before image forming composition layer 12B reaches the contact start position, the stimulus is not applied to image forming composition layer 12B immediately before curable 12B contacts recording medium P.

Moreover, the recitation "a stimulus is applied to image forming composition layer 12B only immediately before curable 12B contacts recording medium P" refers to a situation that the application of stimulus is completed by the time image forming composition layer 12B reaches the contact start position in such a manner that image forming composition layer 12B maintains its liquidity at the contact start position.

In the present exemplary embodiment, as mentioned above, a cationic curable material is used as a curable material contained in image forming composition 12A. Since the curing speed of cationic curable materials is relatively slow, curing reaction thereof gradually progresses even after the application of stimulus has been completed. Therefore, by applying a stimulus to image forming composition layer 12B only immediately before the contact, curable 12B reaches the contact start position while maintaining its liquidity, and the curing reaction thereof gradually progresses without further application of a stimulus. Consequently, image forming composition layer 12B is cured to be readily released by the time it reaches to the release position (a position at which image forming composition layer 12B is released from intermediate transfer drum 26).

The recitation "a stimulus is applied to image forming composition layer 12B only immediately before curable 12B contacts recording medium P" specifically refers to, for example, a situation that the time period between the initiation of stimulus application to image forming composition layer 12B and the arrival of image forming composition layer 12B at the contact start position is 10 seconds or less.

In recording apparatus 104, as mentioned above, the application of stimulus is completed immediately before the arrival of image forming composition layer 12B onto which inkjet droplets 14A have been applied by inkjet recording head 14 at the contact start position.

Subsequently, image forming composition layer 12B is brought into contact with recording medium P at the contact start position with a pressure applied by pressure roller 16A in intermediate transfer drum 26, and is then released from intermediate transfer drum 26 at the release position.

Other features of this exemplary embodiments may be similar to those of the third exemplary embodiment.

In the present exemplary embodiment, since application of a stimulus to image forming composition layer 12B is completed immediately before the arrival of image forming composition layer 12B formed on intermediate transfer drum 26 at the contact start position, image forming composition layer 12B contacts recording medium P while maintaining its liquidity. Therefore, image forming composition layer 12B may adhere to recording medium P in a favorable manner.

Further, since curing reaction of image forming composition layer 12B progresses during the time period between a point at which image forming composition layer 12B passes through the contact start position and a point at which image forming composition layer 12B reaches the release position, internal cohesion of image forming composition layer 12B is increased by the time image forming composition layer 12B reaches the release position. Therefore, liquid separation (image forming composition layer 12B remains on both intermediate transfer drum 26 and recording medium P upon releasing) may be suppressed. Moreover, since image forming composition layer 12B is in a cured state, adhesion at the surface of image forming composition layer 12B may be decreased and releasing properties thereof may be improved.

Additionally, since curing reaction of the curable material progresses when image forming composition layer 12B is adhered to recording medium P in a favorable manner, image forming composition layer 12B may be firmly adhered to recording medium P to form a film, thereby suppressing image forming composition layer 12B from remaining on intermediate transfer drum 26 upon releasing.

For the reasons as set forth above, transfer efficiency of image forming composition layer 12B from intermediate transfer drum 26 to recording medium P may be improved.

In the present exemplary embodiment, as mentioned above, a stimulus is applied to image forming composition layer 12B only immediately before image forming composition layer 12B contacts recording medium P. However, the present exemplary embodiment is not limited to the above configuration as long as a stimulus is applied to image forming composition layer 12B at least immediately before image forming composition layer 12B contacts recording medium P, or while image forming composition layer 12B are contacting recording medium P. Specific examples of the possible configurations are similar to those of the first exemplary embodiment.

In the present exemplary embodiment, a cationic curable material is used as a curable material. However, other curable material such as a radical curable material may also be used.

When a radical curable material is used a curable material, the recitation "a stimulus is applied to image forming composition layer 12B only immediately before curable 12B comes into contact with recording medium P" specifically refers to, for example, a situation that the time period between the initiation of stimulus application to image forming composition layer 12B and the arrival of image forming composition layer 12B at the contact start position is 5 seconds or less.

Fifth Exemplary Embodiment

Figure 5:
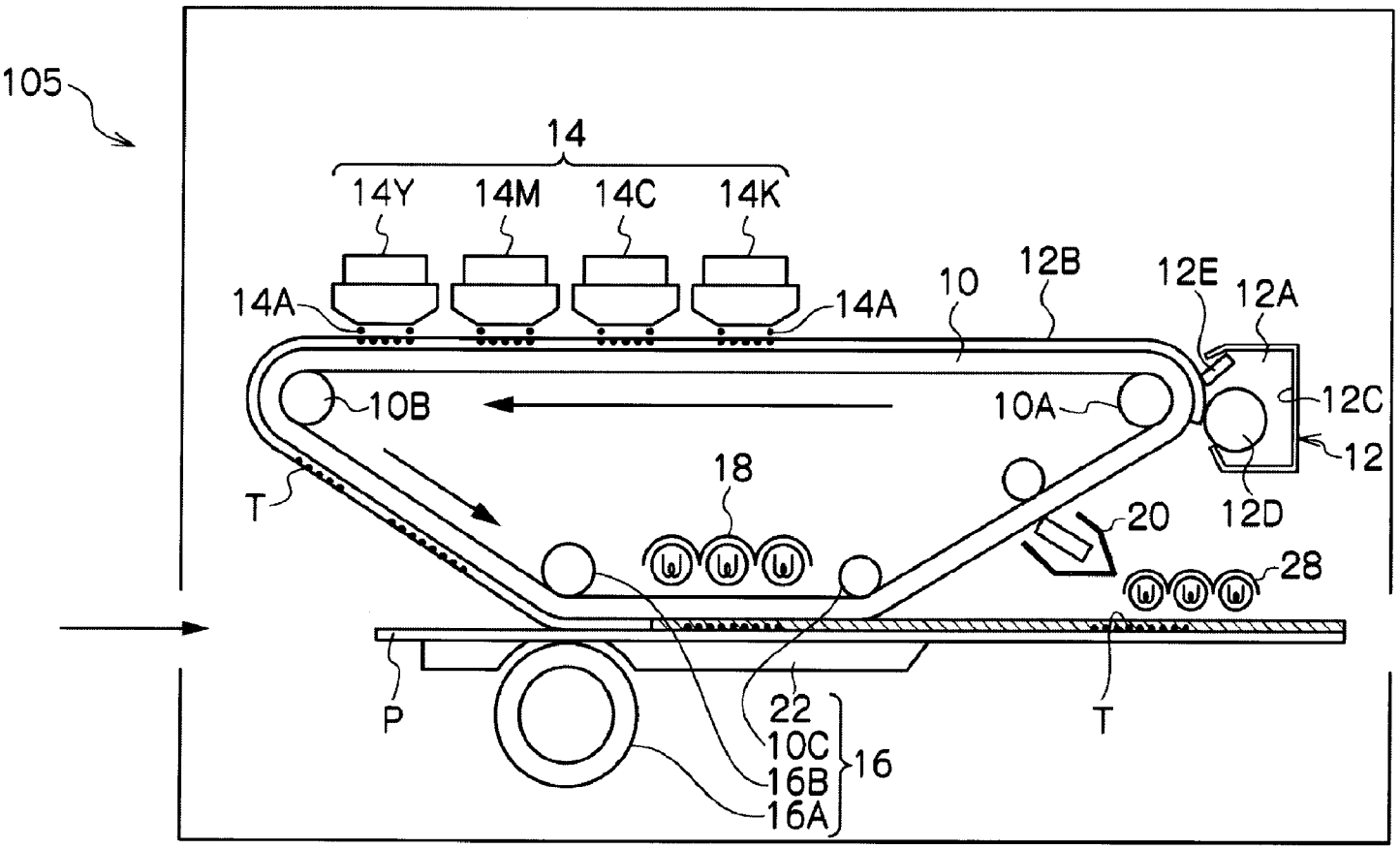
FIG. 5 is a configurational drawing showing a recording apparatus according to a fifth exemplary embodiment of the invention.

FIG. 5 is a configurational drawing showing a recording apparatus according to a fifth exemplary embodiment of the present invention.

Recording apparatus 105, as shown in FIG. 5, has a configuration in which a stimulus application unit 28 (hereinafter, referred to as a second stimulus application unit 28 sometimes) is provided downstream of stimulus application unit 18 (hereinafter, referred to as a first stimulus application unit 18 sometimes), in a moving direction of recording medium P, in recording apparatus 101 of the first exemplary embodiment.

Second stimulus application unit 28 applies a stimulus to image forming composition layer 12B that has been transferred to recording medium P for further curing and fixing of image forming composition layer 12B to recording medium P.

First stimulus application unit 18 is provided inside of intermediate transfer belt 10 and applies a stimulus (such as UV rays) to image forming composition layer 12B, which is in contact with both intermediate transfer belt 10 and recording medium P, through intermediate transfer belt 10.

Second stimulus application unit 28 is provided outside intermediate transfer belt 10 and on the side opposite to the surface of recording medium P onto which image forming composition layer 12B has been formed, and applies a stimulus (such as UV rays) directly to image forming composition layer 12B that has been released from intermediate transfer belt 10.

First stimulus application unit 18 and second stimulus application unit 28 each may be a UV irradiator. Similar devices that may be used for first stimulus application unit 18 may also be used for second stimulus application unit 28. Other configurations and image forming methods may be similar to those mentioned in the first exemplary embodiment.

In the following, an embodiment in which first and second stimulus application units 18 and 28 are first and second UV irradiators 18 and 28, respectively, is described.

In this embodiment, the amount of UV rays applied from first UV irradiator 18 to image forming composition layer 12B (hereinafter, referred to as a "first UV irradiance" sometimes) is not less than the "transfer stimulus amount" but less than "fixing stimulus amount". Further, the total amount of UV rays applied from first UV irradiator 18 to image forming composition layer 12B and UV rays applied from second UV irradiator 29 to image forming composition layer 12B (hereinafter, referred to as a "second UV irradiance" sometimes) is more than the "fixing stimulus amount". When the above conditions are satisfied, transfer efficiency of image forming composition layer 12B from intermediate transfer belt 10 to recording medium P may be enhanced, degradation of intermediate transfer belt 10 may be suppressed, and fixing properties of an image to recording medium P may be improved.

The above "transfer stimulus amount" refers to a minimum amount of UV rays that cures image forming composition layer 12B so that image forming composition layer 12B may be readily released from intermediate transfer belt 10 at a release position. Specifically, for example, "transfer stimulus amount" is a minimum amount of UV rays that cures image forming composition layer 12B to a curing ratio of 10% or about 10%.

The above "fixing stimulus amount" refers to a minimum amount of UV rays that completely cures image forming composition layer 12B. Specifically, for example, the "fixing stimulus amount" is a minimum amount of UV rays that cures image forming composition layer 12B to a curing ratio of 80% or about 80%.

The curing ratio of image forming composition layer 12B after having been irradiated with first UV irradiance may be, as mentioned above, from 10% or about 10% to less than 80% or less than about 80%, preferably from 10% to less than 70%, and more preferably from 10% to less than 60%.

The curing ratio of image forming composition layer 12B after having been irradiated with second UV irradiance may be, as mentioned above, more than 80% or more than about 80%, and more preferably from 85% to 100%.

The curing ratio of image forming composition layer 12B refers to a degree of progression of curing reaction of image forming composition layer 12B, which is measured by a Fourier-transform infrared spectrograph (FT-IR) and calculated from the rate of change in peak intensity of an IR spectrum.

The integrated light intensity of first UV irradiance is, for example, preferably from 10 $mJ/cm^2$ to less than 5000 $mJ/cm^2$ and more preferably from 10 $mJ/cm^2$ to less than 1000 $mJ/cm^2$.

The total integrated light intensity of first and second UV irradiances depends on the type of UV curable material or the thickness of image forming composition layer 12B, but is preferably from 20 $mJ/cm^2$ to less than 10000 $mJ/cm^2$ and more preferably from 50 $mJ/cm^2$ to less than 4000 $mJ/cm^2$.

The reasons for the above-mentioned effects are as follows.

Image forming composition layer 12B is irradiated with UV rays by first UV irradiator 18, in an amount that is more than the transfer stimulus amount, while image forming composition layer 12B formed on intermediate transfer belt 10 is contacting recording medium P. Therefore, transfer efficiency of image forming composition layer 12B may be improved.

Namely, image forming composition layer 12B formed on intermediate transfer belt 10 contacts recording medium P in a liquid state at the contact start position, before being irradiated with UV rays. Image forming composition layer 12B is then irradiated with UV rays in an amount that is more than the transfer stimulus amount, by first UV irradiator 18 to promote the curing reaction of image forming composition layer 12B. Therefore, image forming composition layer 12B is tightly fixed to recording medium P. Further, since internal cohesion of image forming composition layer 12B is sufficiently increased by irradiation with UV rays in an amount that is more than the transfer stimulus amount, adhesion of the surface of image forming composition layer 12B is decreased and image forming composition layer 12B is readily released from intermediate transfer belt 10 at the release position. Accordingly, liquid separation (image forming composition layer 12B remains on both intermediate transfer belt 10 and recording medium upon releasing) may be suppressed to improve transfer efficiency of image forming composition layer 12B.

On the other hand, as mentioned above, image forming composition layer 12B is irradiated with UV rays while contacting intermediate transfer belt 10. Therefore, there is a fear that intermediate transfer belt 10 may deteriorate due to UV rays absorbed by intermediate transfer belt 10 or heat generated by curing reaction of image forming composition layer 12B. However, in the present exemplary embodiment, since the amount of first UV irradiance is less than fixing stimulus amount, deterioration of intermediate transfer belt 10 may be suppressed.

Moreover, since image forming composition layer 12B that has been released from intermediate transfer belt 10 is irradiated with UV rays by second UV irradiator 28, the total amount of first UV irradiance and second UV irradiance is more than the fixing stimulus amount. Therefore, fixing properties of the image may also be improved.

In the present exemplary embodiment, a spectrum in a wavelength range of from 250 nm to 500 nm of UV rays or the like applied from first UV irradiator 18 to image forming composition layer 12B (hereinafter, referred to as a first UV spectrum sometimes) and a spectrum in a wavelength range of from 250 nm to 500 nm of UV rays or the like applied from second UV irradiator 28 to image forming composition layer 12B (hereinafter, referred to as a second UV spectrum sometimes) may satisfy the following requirements.

Specifically, when the integrated irradiation intensity of first UV spectrum in a wavelength range of from 250 nm to 500 nm is "$I_{1T}$", the integrated irradiation intensity of first UV spectrum in a curing wavelength range is "$I_{1C}$", the integrated irradiation intensity of second UV spectrum in a wavelength range of from 250 nm to 500 nm is "$I_{2T}$", and the integrated irradiation intensity of second UV spectrum in a curing wavelength range is "$I_{2C}$", the value of "$I_{1C}/I_{1T}$" is preferably more than the value of "$I_{2C}/I_{2T}$".

The curing wavelength range mentioned above refers to a range of wavelength used for the curing reaction of image forming composition layer 12B, which may be determined depending on the type of polymerization initiator or the like that is contained in image forming composition layer 12B.

For example, when IRGACURE 651 (trade name, manufactured by Ciba Japan K.K) is used as a UV polymerization initiator, the range of curing wavelength is from 310 nm to 370 nm. In this case, the integrated irradiation intensity in the curing wavelength range refers to an integrated value of intensity of UV rays in a wavelength of from 310 nm to 370 nm, out of the UV rays applied to image forming composition layer 12B.

For example, when a high-pressure mercury lamp is used for first UV irradiator 18, the value of "$I_{1C}/I_{1T}$" may be 0.48, and when the same is used for second UV irradiator 28, the value of "$I_{2C}/I_{2T}$" may be 0.35.

When the value of "$I_{1C}/I_{1T}$" is relatively large, the integrated irradiation intensity of UV rays in a wavelength other than the range from 250 nm to 500 nm is relatively small. Since UV rays in a wavelength range other than the curing wavelength range does not contribute to the curing reaction of image forming composition layer 12B, the UV rays within this wavelength range may easily converted to thermal energy. Accordingly, when the value of "$I_{1C}/I_{1T}$" is more than the value of "$I_{2C}/I_{2T}$", deterioration of intermediate transfer belt 10 due to heat may be suppressed.

On the other hand, in the present exemplary embodiment, image forming composition layer 12B is irradiated with UV rays by second UV irradiator 28 after image forming composition layer 12B has been released from intermediate transfer belt 10. Therefore, even when the value of "$I_{2C}/I_{2T}$" is relatively small and the amount of heat generated by UV irradiation is relatively large, intermediate transfer belt 10 may be prevented from being affected by heat generated by UV irradiation to avoid deterioration.

Specifically, for example, the value of "$I_{1C}/I_{1T}$" is preferably 0.30 or more, more preferably 0.40 or more. The value of "$I_{2C}/I_{2T}$" is preferably from 0.05 to 0.70, more preferably from 0.05 to 0.60.

Further, second UV spectrum is preferably broad. Namely, UV rays that have been applied to image forming composition layer 12B may be absorbed by ink or the like and the intensity of UV rays may attenuate. In this regard, when second UV spectrum is broad, UV rays applied from second UV irradiator 28 include UV rays of various wavelengths. Therefore, UV rays that are not easily absorbed by ink or the like may reach the surface of image forming composition layer 12B to be in contact with recording medium P, and fixing properties of image forming composition layer 12B may improve.

The requirements for first and second UV spectra as mentioned above may be satisfied by, for example, selecting the type of first and second UV irradiators 18 and 28.

For example, preferable UV irradiators for first UV irradiator 18 include high-pressure mercury lamp, UV-LED or the like. These UV irradiators are preferable also in terms of reducing the size of recording apparatus 105.

Among these, UV-LED is particularly preferable in terms of obtaining first UV spectrum having a sharp shape. In this case, the value of "$I_{1C}/I_{1T}$" may be even more increased by selecting the type of UV polymerization initiator to conform to the peak wavelength of emission spectrum of UV-LED or by selecting the type of UV-LED having a peak wavelength corresponding to the type of UV polymerization initiator.

Preferable UV irradiators for second UV irradiator 28 include, for example, a metal halide lamp.

The requirements for first and second UV spectra as mentioned above may also be satisfied by disposing a filter between at least one of first and second UV irradiators and image forming composition layer 12B. Alternatively, selection of the type of UV irradiators and the position of the filter may be combined in order that first and second UV spectra satisfy the above requirements.

In the present exemplary embodiment, as mentioned above, since ink droplets 14A are applied to image forming composition layer 12B, image formation may be performed at high quality on either a permeable recording medium or a non-permeable recording medium.

Further, in the present exemplary embodiment, as mentioned above, ink droplets 14A are applied to image forming composition layer 12B formed on intermediate transfer belt 10, and then image forming composition layer 12B is transferred to recording medium P. Therefore, for example, if image forming composition layer 12B is thick enough so that ink droplets 14A do not reach the bottom of image forming composition layer 12B, a portion of image forming composition layer 12B including ink droplets 14A is not exposed after image forming composition layer 12B has been transferred to recording medium P, and a portion of image forming composition layer 12B not including ink droplets 14A may serve as a protective layer after being cured. Accordingly, no difference in height in a printed region and a non-printed region is created, thereby improving the durability of formed image.

In the present exemplary embodiment, as mentioned above, first UV irradiator 18 is inside of intermediate transfer belt 10, and UV rays or the like are applied to image forming composition layer 12B through intermediate transfer belt 10. Therefore, the amount of UV irradiation and the extent of curing reaction on the side of image forming composition layer 12B contacting intermediate transfer belt 10 are more than that on the side of image forming composition layer 12B contacting recording medium P. Therefore, curing reaction progresses more on the side of image forming composition layer 12B contacting intermediate transfer belt 10 than the side of image forming composition layer 12B contacting recording medium P. Accordingly, image forming composition layer 12B becomes more likely to be released from intermediate transfer belt 10 than from recording medium P, thereby further improving the transfer efficiency of image forming composition layer 12B from intermediate transfer belt 10 to recording medium P.

In the present exemplary embodiment, as mentioned above, ink droplets 14A are applied to image forming composition layer 12B formed on intermediate transfer belt 10, and UV rays are applied to image forming composition layer 12B through intermediate transfer belt 10. Therefore, for example, if image forming composition layer 12B is thick enough so that ink droplets 14A do not reach the bottom of image forming composition layer 12B, the amount of ink droplets 14A in a portion of image forming composition layer 12B that contacts intermediate transfer belt 10 may be reduced. Accordingly, inhibition of curing due to absorption of UV rays or the like by ink droplets 14A may be suppressed. Consequently, the amount of transfer stimulus may be reduced and the amount of first UV irradiance may be decreased, thereby further suppressing deterioration of intermediate transfer belt 10.

In the present exemplary embodiment, as mentioned above, UV rays are applied by first UV irradiator 18 to image forming composition layer 12B through intermediate transfer belt 10. Therefore, the configuration of recording apparatus 105 may be simplified. If UV rays are applied from the outside of intermediate transfer belt 10, support 22 and recording medium P need to be made from a UV-transmissive material. However, in the present exemplary embodiment, application of UV rays to image forming composition layer 12B and recording medium P while contacting each other may be more easily achieved without the above restriction.

In the present exemplary embodiment, as mentioned above, first UV irradiator 18 is positioned inside intermediate transfer belt 10. Therefore, recording apparatus 105 may be more space-saving than a recording apparatus having first UV irradiator 18 outside intermediate transfer belt 10.

In the present exemplary embodiment, as mentioned above, UV irradiation by first UV irradiator 18 is initiated after image forming composition layer 12B has passed the contact start position, and is completed before image forming composition layer 12B reaches the release position. However, the present exemplary embodiment is not limited to the above configuration as long as the UV irradiation by first UV irradiator 18 is carried out at least one of immediately before image forming composition layer 12B contacts recording medium P, or while image forming composition layer 12B is contacting recording medium P.

Specifically, for example, the UV irradiation by first UV irradiator 18 may be initiated when image forming composition layer 12B passes the contact start position, or may be initiated before image forming composition layer 12B passes the contact start position. Further, for example, the UV irradiation by first UV irradiator 18 may be completed when image forming composition layer 12B reaches the release position, or may be completed before image forming composition layer 12B reaches the release position. Moreover, the UV irradiation by first UV irradiator 18 may stop and start again during the time period between the initiation and completion of irradiation. Additionally, the UV irradiation by first UV irradiator 18 may be completed before image forming composition layer 12B reaches the contact start position (the irradiation may be conducted only immediately before image forming composition layer 12B contacts recording medium P).

In an exemplary embodiment in which the UV irradiation by first UV irradiator 18 is completed after image forming composition layer 12B has passed the release position, the amount of UV irradiation that is applied to image forming composition layer 12B during the time period between the initiation of irradiation and the arrival of image forming composition layer 12B at the release position (before image forming composition layer 12B is released from intermediate transfer belt 10) is determined as "first UV irradiance". On the other hand, the amount of UV irradiation that is applied to image forming composition layer 12B after image forming composition layer 12B has passed the release position is included in "second UV irradiance".

The UV irradiation by first UV irradiator 18 may be conducted immediately before image forming composition layer 12B contacts recording medium P. In this case, the UV irradiation is initiated before image forming composition layer 12B reaches the contact start position and conducted so that image forming composition layer 12B maintains its liquidity at the contact start position. Namely, when the UV irradiation is initiated before image forming composition layer 12B reaches the contact start position so that image forming composition layer 12B is cured to lose its liquidity at the contact start position, the UV irradiation is not considered to be conducted immediately before image forming composition layer 12B contacts recording medium P.

The UV irradiation by first UV irradiator 18 may be conducted only immediately before image forming composition layer 12B contacts recording medium P. In this case, the UV irradiation is initiated and completed before image forming composition layer 12B reaches the contact start position while maintaining its liquidity. Namely, since the curing reaction of image forming composition layer 12B that has been irradiated with UV rays and has reached the contact start position while maintaining its liquidity is further promoted without further irradiation, image forming composition layer 12B is cured to be easily released from intermediate transfer belt 10 by the time it reaches the release position.

When the UV irradiation by first UV irradiator 18 is conducted immediately before image forming composition layer 12B contacts recording medium P, for example, when a radical curable material is used as a curable material, the time period between the initiation of irradiation and the arrival of image forming composition layer 12B at the contact start position is 5 seconds or less. When a cationic curable material is used as a curable material, for example, the time period between the initiation of irradiation and the arrival of image forming composition layer 12B at the contact start position is 10 seconds or less.

In the present exemplary embodiment, as mentioned above, first UV irradiator 18 is inside of intermediate transfer belt 10 and UV rays are applied to image forming composition layer 12B through intermediate transfer belt 10. However, the present exemplary embodiment is not limited to the above configuration. Specifically, for example, UV irradiator 18 may be positioned outside intermediate transfer belt 10 and UV rays may be directly applied to image forming composition layer 12B (or through support 22 and recording medium P) without passing through intermediate transfer belt 10.

Alternatively, for example, UV rays may be applied to image forming composition layer 12B through intermediate transfer belt 10 while the main body of UV irradiator 18 is outside intermediate transfer belt 10. Specifically, for example, UV rays may be introduced from first UV irradiator 18 positioned outside intermediate transfer belt 10 to the inside thereof, by means of optical fibers or the like, in order to irradiate image forming composition layer 12B with UV rays through intermediate transfer belt 10.

In the present exemplary embodiment, for example, second UV irradiator 28 applies UV rays directly to curable 12B. However, it is also possible that UV rays are applied by second UV irradiator 28 to curable 12B through recording medium P or the like.

In the foregoing, first and second stimulus application unit are described as first and second UV irradiators 18 and 28, respectively. However, the present exemplary embodiment is not limited thereto, and other devices described in the first exemplary embodiment are also applicable.

In the present exemplary embodiment, as described in the second exemplary embodiment, recording apparatus 105 may have a release agent application unit that applies a release agent to intermediate transfer belt 10 to form a release agent layer, before the formation of image forming composition layer 12B. Preferable embodiments thereof are similar to those descried in the second exemplary embodiment.

Further, as described in the third and fourth exemplary embodiments, recording apparatus 105 may have intermediate transfer drum 26 instead of intermediate transfer belt 10, and preferable embodiments thereof are similar. In this case, as mentioned above, a release agent application unit may also be provided.

In the above explanation, a full-color image is formed by selectively ejecting ink droplets 14A of black, yellow, magenta and cyan onto recording medium P. However, the present exemplary embodiment is not limited to recording of characters or images. For example, the recording apparatus of the present exemplary embodiment may be used for applications such as droplet application (jetting) devices in general for industrial use, method of forming an image by transfer using printing plates, method of forming an image by screen printing, or the like.

Sixth Exemplary Embodiment

Figure 6:
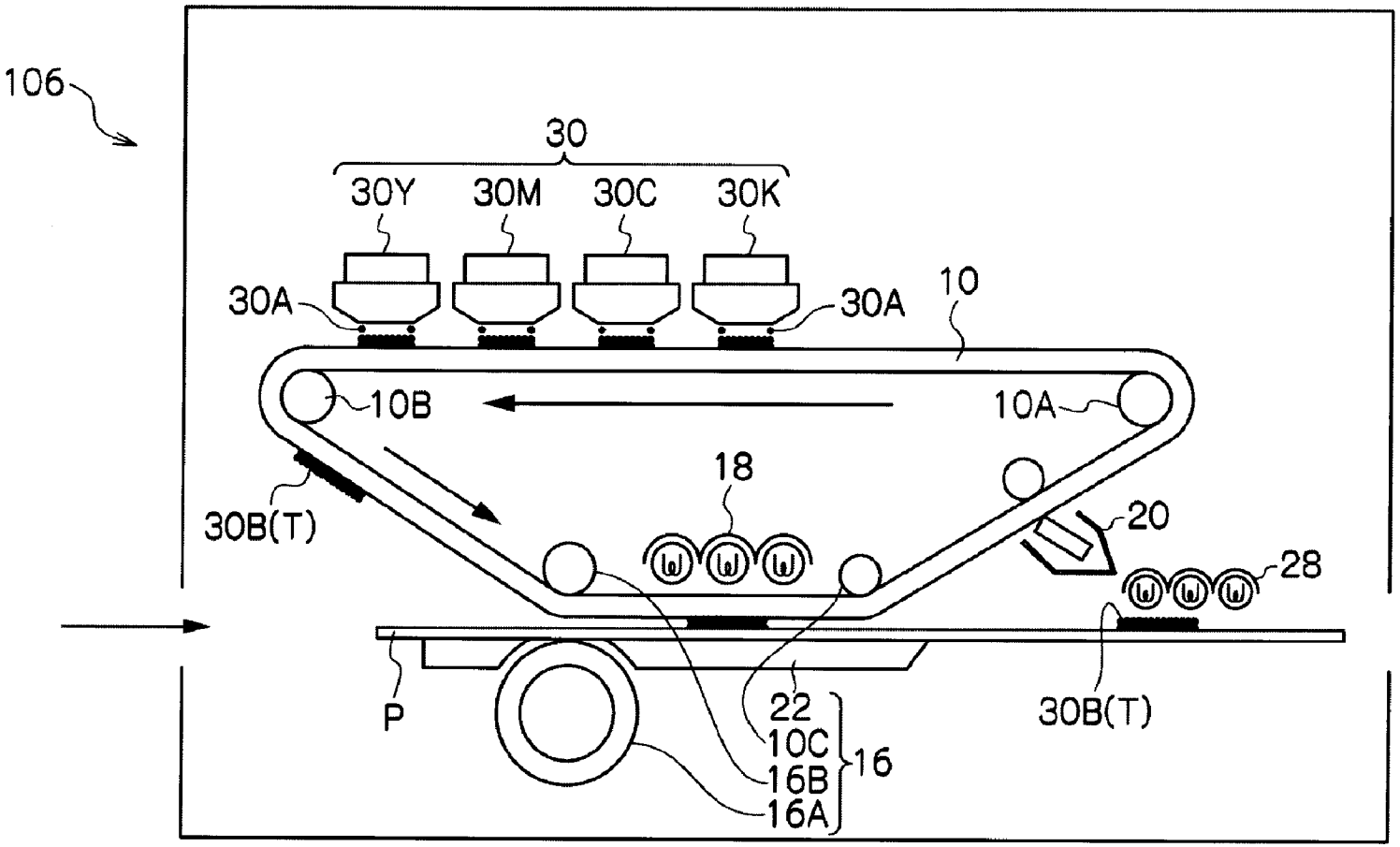
FIG. 6 is a configurational drawing showing a recording apparatus according to a sixth exemplary embodiment of the invention.

FIG. 6 is a configurational drawing showing a recording apparatus according to a sixth exemplary embodiment.

In recording apparatus 106, as shown in FIG. 6, inkjet recording heads 30 directly supplies ink droplets 30A containing an image forming composition to intermediate transfer belt 10 to form an ink layer 30B (corresponding to image forming composition layer) thereon, without using composition supply unit 12 in recording apparatus 105.

Inkjet recording head 30 may be similar to inkjet recording heads 14 used in the fifth exemplary embodiment.

In recording apparatus 106, ink droplets 30A that have been applied directly onto intermediate transfer belt 10 from inkjet recording heads 30 to form ink layer 30B (image T).

Subsequently, as mentioned in the first exemplary embodiment, ink layer 30B is transferred from intermediate transfer belt 10 to recording medium P by transfer unit 16. Recording medium P and intermediate transfer belt 10 are nipped by pressure rollers 16A and 16B and a pressure is applied thereto. At this time, ink layer 30B contacts recording medium P (contact start position). Thereafter, ink layer 30B maintains the state of contacting both intermediate transfer belt 10 and recording medium P until ink layer 30B reaches a point to be nipped by support roller 10C and support 22 (release position).

The pressure applied to ink layer 30B by pressure rollers 15A and 16B is preferably in the range of from 0.001 MPa to 2 MPa, in view of improving transfer efficiency and suppressing image disorders.

A stimulus such as UV rays is then applied from first stimulus application unit 18 to ink layer 30B in contact with both intermediate transfer belt 10 and recording medium P, through intermediate transfer belt 10 to cure ink layer 30B. Ink layer 30B that has been applied with a stimulus in an amount of equal to or larger than the transfer stimulus amount is released from intermediate transfer belt 10 at the release position.

A stimulus is further applied to ink layer 30B that has been released from intermediate transfer belt 10 from second stimulus application unit 28, directly onto the side of ink layer 30B that is contacting recording medium P to further cure ink layer 30B to fix to recording medium P.

On the other hand, residuals or other matters remaining on the surface of intermediate transfer belt 10 after ink layer 30B has been released therefrom are removed by cleaning unit 20.

Thereafter, ink droplets 30A are supplied again to intermediate transfer belt 10 to form ink layer 30B thereon, and an image forming process is repeated.

Other features of this exemplary embodiment are similar to those described in the fifth exemplary embodiment.

In the recording apparatus according to the present exemplary embodiment, as is the case with the fifth exemplary embodiment, when UV-ray curable ink is used as an image forming composition, transfer efficiency of ink layer 30B from intermediate transfer belt 10 to recording medium P may be improved and degradation of intermediate transfer belt 10 may be suppressed. Further, fixing properties of the formed image may be favorable. Specific reasons for these effects are as described in the fifth exemplary embodiment.

In the above explanation, a full-color image is formed by selectively ejecting ink droplets 30A of black, yellow, magenta and cyan onto recording medium P. However, the present exemplary embodiment is not limited to recording of characters or images. For example, the recording apparatus of the present exemplary embodiment may be used for applications such as droplet application (jetting) devices in general for industrial use, method of forming an image by transfer using printing plates, method of forming an image by screen printing, or the like.

The following are details of image forming composition 12A.

Image forming composition 12A includes a curable material that cures upon application of an external stimulus (energy). Here, the curable material that cures upon application of an external stimulus (energy) refers to a material that cures upon application of an external stimulus to form a "curable resin". Specific examples thereof include curable monomers, curable macromers, curable oligomers and curable prepolymers.

The curable materials include UV-ray curable materials, electron-beam curable materials, thermosetting materials, and the like. The UV-ray curable materials are most preferable since these are easily cured and have a high curing rate, as compared with other types of materials, and thus are easy to handle. The electron-beam curable materials can be cured without using a polymerization initiator, and thus the coloring state of the layer after curing can be easily controlled. The thermosetting materials can be cured without using a large-scale apparatus. In the invention, the curable materials are not restricted thereto, and materials that can be cured with moisture, oxygen, or the like, may also be used.

The "UV-ray curable resins" obtained by curing a UV-ray curable material include, for example, an acrylic resin, a methacrylic resin, a urethane resin, a polyester resin, a maleimide resin, an epoxy resin, an oxetane resin, a polyether resin, and a polyvinyl ether resin. The image forming composition 12A contains at least one kind of a UV-ray curable monomer, a UV-ray curable macromer, a UV-ray curable oligomer, and a UV-ray curable prepolymer. Further, image forming composition 12A preferably includes a UV polymerization initiator for promoting the curing reaction due to UV rays. Moreover, image forming composition 12A may further include a reaction aid, a polymerization promoter, or the like to further promote the polymerization of image forming composition 12A.

The UV-ray curable monomers include, for example, radical curable materials such as an acrylic ester of alcohols, polyhydric alcohols and amino alcohols, a methacrylic acid ester of alcohols and polyhydric alcohols, an acrylic aliphatic amide, an acrylic alicyclic amide, and an acrylic aromatic amide; cationic curable materials such as an epoxy monomer, an oxetane monomer, and a vinylether monomer. The UV-ray curable macromers, the UV-ray curable oligomers, and the UV-ray curable prepolymers include those prepared by polymerizing these monomers at a certain polymerization degree, and radical curable materials such as an epoxy acrylate, a urethane acrylate, a polyester acrylate, a polyether acrylate, a urethane methacrylate and a polyester methacrylate formed by adding an acryloyl group or a methacryloyl group to an epoxy, urethane, polyester or polyether skeleton.

When the curing reaction progresses through a radical reaction, UV-ray polymerization initiators that can be used include, for example, benzophenone, thioxanthone-type initiators, benzyl dimethyl ketal, an α-hydroxyketone, an α-hydroxy alkylphenone, an α-aminoketone, an α-amino alkylphenone, a monoacylphosphine oxide, a bisacylphosphine oxide, hydroxybenzophenone, aminobenzophenone, titanocene-type initiators, oxime ester-type initiators, oxyphenylacetate-type initiators, and the like.

Further, when the curing reaction progresses through a cationic reaction, the UV-ray polymerization initiators that can be used include, for example, an aryl sulfonium salt, an aryl diazonium salt, a diaryl iodonium salt, a triaryl sulfonium salt, an allene-ion complex derivative, a triazine-type initiator, and the like.

The "electron-beam curable resins" obtained by curing the electron-beam curable material include, for example, an acrylic resin, a methacrylic resin, a urethane resin, a polyester resin, a polyether resin, a silicone resin, and the like. The image forming composition 12A in this case contains at least one kind of an electron-beam curable monomer, an electron-beam curable macromer, an electron-beam curable oligomer, and an electron-beam curable prepolymer.

Examples of the electron-beam curable monomer, the electron-beam curable macromer, the electron-beam curable oligomer, and the electron-beam curable prepolymer include materials similar to the aforementioned UV-ray curable materials.

The "thermosetting resins" obtained by curing the thermosetting material include an epoxy resin, a polyester resin, a phenol resin, a melamine resin, a urea resin, an alkyd resin, and the like. The image forming composition 12A in this case contains at least one kind of a thermosetting monomer, a thermosetting macromer, a thermosetting oligomer and a thermosetting prepolymer. Further, a curing agent may be added at the time of polymerization. In order to promote the thermal curing reaction, image forming composition 12A may also contain a thermal polymerization initiator.

The thermosetting monomers include, for example, phenol, formaldehyde, bisphenol A, epichlorohydrin, cyanuric acid amide, urea, polyalcohols such as glycerin, and acids such as phthalic anhydride, maleic anhydride and adipic acid. The thermosetting macromers, thermosetting oligomers and thermosetting prepolymers include those obtained by polymerizing the aforementioned monomers to a predetermined polymerization degree, an epoxy prepolymer, a polyester prepolymer, and the like.

The thermal polymerization initiators include, for example, acids such as protic acid/Lewis acid, an alkali catalyst, a metal catalyst, and the like.

As mentioned above, the curable material is not restricted as long as the material is cured (for example, as a result of the progress of polymerization reaction) by an external energy such as UV rays, electron beams or heat. In view of increasing the speed of image forming, materials with a high curing rate (for example, materials having a high polymerization reaction rate) are desirable. Examples of such curable materials include radiation curable materials (such as the above-mentioned UV-ray curable materials and electron-beam curable materials).

In view of improving the wetting property of the curable material to the intermediate transfer member or the like, the curable material may be modified with silicon, fluorine, or the like. Further, in consideration of the curing rate and curing degree, the curable material preferably include a polyfunctional prepolymer.

Image forming composition 12A may include water or an organic solvent to dissolve or disperse the main component that contributes to the curing reaction (such as a monomer, a macromer, an oligomer, a prepolymer, or a polymerization initiator). In this case, the content of the main component in the composition may be 30% by weight or more, more preferably 60% by weight or more, and further preferably 90% by weight or more.

Image forming composition 12A may include a colorant in order to control the coloring state of the layer after curing.

Image forming composition 12A may have a viscosity of from 5 mPa·s to 10,000 mPa·s, from 10 mPa·s to 1,000 mPa·s, or from 15 mPa·s to 500 mPa·s. The viscosity of image forming composition 12A is preferably higher than the viscosity of the ink.

Image forming composition 12A may include a material that fixes the colorant contained in the ink.

Preferable materials include a material having an ability of absorbing the ink (liquid absorbing material). The liquid absorbing material may be defined as a material whose weight increases by 5% or more, after being mixed with ink at a weight ratio of 30:100 (liquid absorbing material: ink) for 24 hours and then taken out from the mixture using a filter.

By including a liquid absorbing material in image forming composition, a liquid component of the ink (such as water or organic solvent) is rapidly taken into a resin layer to fix an image. Therefore, color mixing at a border of inks of different colors, image irregularities, or uneven transfer of the ink upon application of pressure may be alleviated.

Examples of liquid absorbing materials include resins (sometimes referred to as liquid absorbing resins) and inorganic particles having a surface compatible with ink (such as those of silica, alumina or zeolite). The liquid absorbing material may be selected depending on the type of the ink.

Namely, when an aqueous ink is used, a water-absorbing material is preferably used, and when an oily ink is used, an oil-absorbing material is preferably used.

Specific examples of the material for the water-absorbing resin particles include polyacrylic acid and a salt thereof, polymethacrylic acid and a salt thereof, a copolymer of (meth)acrylic acid ester-(meth)acrylic acid or a salt thereof, a copolymer formed from an alcohol having an aliphatic group or an aromatic-substituted group and a structure of styrene-(meth)acrylic acid-carboxylic acid or a salt thereof and an ester obtained from (meth)acrylic acid, a copolymer formed from an alcohol having an aliphatic group or an aromatic-substituted group and a structure of (meth)acrylic acid ester-carboxylic acid or a salt thereof and an ester obtained from (meth)acrylic acid, a copolymer of ethylene-(meth)acrylic acid, a copolymer formed from an alcohol having an aliphatic group or an aromatic-substituted group and a structure of butadiene-(meth)acrylic acid ester-carboxylic acid or a salt thereof and an ester obtained from (meth)acrylic acid, a copolymer of polymaleic acid and a salt thereof, a copolymer of styrene-maleic acid or a salt thereof, a sulfonic-acid-modified product of the above resins, and a phosphoric-acid-modified product of the above resins.

Among these, polyacrylic acid and a salt thereof, a copolymer of styrene-(meth)acrylic acid or a salt thereof, a copolymer of styrene-(meth)acrylic acid ester-(meth)acrylic acid or a salt thereof, a copolymer formed from an alcohol having an aliphatic group or an aromatic-substituted group and a structure of styrene-(meth)acrylic acid ester-carboxylic acid or a salt thereof and an ester obtained from (meth)acrylic acid, and a copolymer of (meth)acrylic acid ester-(meth)acrylic acid or a salt thereof are preferable. These resins may be crosslinked or may not be crosslinked.

Specific examples of the material for the oil-absorbing resin particles include low-molecular gelation agent such as hydroxy stearic acid, cholesterol derivatives or benzylidene sorbitol, polynorbornene, polystyrene, polypropylene, styrene-butadiene copolymers, and rosins. Among these, polynorbornene, polypropylene and rosins are preferable.

When the liquid absorbing material is in the form of particles, the volume average diameter is preferably from 0.05 μm to 25 μm, more preferably from 0.05 μm to 5 μm.

The content of the liquid absorbing material in the total weight of image forming composition 12A is preferably 10% by weight or more, more preferably 20% by weight or more, and further preferably from 25% by weight to 70% by weight.

Image forming composition 12A may further contain other additives. For example, image forming composition 12A may include a component that promotes aggregation of the component in the ink or increases the viscosity of the ink.

The component as described above may be included in the composition as a functional group of a resin (liquid absorbing resin) that forms the aforementioned liquid absorbing particles, or as a compound. Examples of the functional group include a carboxylic group, a polyfunctional metal cation, and polyamines.

Examples of the aforementioned compound include aggregation agents such as inorganic electrolytes, organic acids, inorganic acids, and organic amines.

Examples of the inorganic electrolytes include a salt of an alkaline metal ion such as a lithium ion, a sodium ion, a potassium ion, or a polyvalent metal ion such as an aluminum ion, a barium ion, a calcium ion, a copper ion, an iron ion, a magnesium ion, a manganese ion, a nickel ion, a tin ion, a titanium ion, and a zinc ion; and an inorganic acid such as hydrochloric acid, bromic acid, hydriodic acid, sulfuric acid, nitric acid, phosphoric acid and thiocyanic acid, an organic carboxylic acid such as acetic acid, oxalic acid, lactic acid, fumaric acid, citric acid, salicylic acid and benzoic acid, and an organic sulfonic acid.

Specific examples of the above inorganic electrolytes include an alkaline metal salt such as lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate; and a polyvalent metal salt such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogen phosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

Specific examples of the organic acids include arginine acid, citric acid, glycine, glutamic acid, succinic acid, tartaric acid, cysteine, oxalic acid, fumaric acid, phthalic acid, maleic acid, malonic acid, lycine, malic acid, and a compound represented by the following Formula (1) and derivatives thereof.

Formula (1)

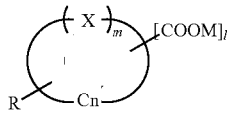

In Formula (1), X represents O, CO, NH, $NR_1$, S or $SO_2$, preferably CO, NH, $NR_1$ or O, and more preferably CO, NH or O, where $R_1$ is an alkyl group, preferably $CH_3$, $C_2H_5$ or $C_2H_4OH$; R represents an alkyl group, preferably $CH_3$, $C_2H_5$ or $C_2H_4OH$, and R may be included in Formula 1 or may not be included; M represents a hydrogen atom, an alkali metal or an amine and is preferably H, Li, Na, K, monoethanol amine, diethanol amine, triethanol amine or the like, more preferably H, Na or K, and further preferably a hydrogen atom; n represents an integer of from 3 to 7 and is preferably an integer with which the heterocyclic ring is a six-membered or five-membered ring, and more preferably an integer with which the heterocyclic ring is a five-membered ring; m represents 1 or 2; and 1 represents an integer of from 1 to 5. The compound represented by Formula (I) may be a saturated ring or an unsaturated ring.

Examples of the compounds represented by Formula (1) include compounds having a structure of furan, pyrrole, pyrroline, pyrrolidone, pyrone, pyrrole, thiophene, indole, pyridine or quinoline, and further including a carboxyl group as a functional group. Specific examples of the compounds include 2-pyrrolidone-5-carboxylic acid, 4-methyl-4-pentanolide-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolide-3-carboxylic acid, 3-hydroxy-4-pyrone-2,6-dicarboxylic acid, 2-pyrone-6-carboxylic acid, 4-pyrone- 2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophene carboxylic acid, 2-pyrrole carboxylic acid, 2,3-dimethylpyrrole-4-carboxylic acid, 2,4,5-trimethylpyrrole-3-propionic acid, 3-hydroxy-2-indole carboxylic acid, 2,5-dioxo-4-methyl-3-pyrroline-3-propionic acid, 2-pyrrolidine carboxylic acid, 4-hydroxyproline, 1-methylpyrrolidine-2-carboxylic acid, 5-carboxy-1-methyl pyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methyl nicotinic acid, 2-quinoline carboxylic acid, 4-quinoline carboxylic acid, 2-phenyl-4-quinoline carboxylic acid, 4-hydroxy-2-quinoline carboxylic acid, and 6-methoxy-4-quinoline carboxylic acid.

Preferable examples of the organic acids include citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives or salts thereof. The organic acid is more preferably pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or a derivative or salt thereof. The organic acid is further preferably pyrrolidone carboxylic acid, pyrone carboxylic acid, furan carboxylic acid, coumaric acid, or a derivative or salt thereof.

An organic amine compound may be any of a primary amine, secondary amine, tertiary amine, quaternary amine and a salt thereof. Specific examples of the organic amine compounds include a tetraalkyl ammonium, alkylamine, benzalconium, alkylpyridium, imidazolium, polyamine and a derivative or a salt thereof, such as amyl amine, butyl amine, propanol amine, propyl amine, ethanol amine, ethyl ethanol amine, 2-ethyl hexyl amine, ethyl methyl amine, ethyl benzyl amine, ethylene diamine, octyl amine, oleyl amine, cyclooctyl amine, cyclobutyl amine, cyclopropyl amine, cyclohexyl amine, diisopropanol amine, diethanol amine, diethyl amine, di-2-ethylhexyl amine, diethylene triamine, diphenyl amine, dibutyl amine, dipropyl amine, dihexyl amine, dipentyl amine, 3-(dimethylamino)propyl amine, dimethyl ethyl amine, dimethyl ethylene diamine, dimethyl octyl amine, 1,3-dimethyl butyl amine, dimethyl-1,3-propane diamine, dimethyl hexyl amine, amino-butanol, amino-propanol, amino-propane diol, N-acetylamino ethanol, 2-(2-aminoethyl amino) ethanol, 2-amino-2-ethyl-1,3-propane diol, 2-(2-aminoethoxy) ethanol, 2-(3,4-dimethoxyphenyl) ethyl amine, cetyl amine, triisopropanol amine, triisopentyl amine, triethanol amine, trioctyl amine, trityl amine, bis(2-aminoethyl) 1,3-propane diamine, bis(3-aminopropyl) ethylene diamine, bis(3-aminopropyl)1,3-propane diamine, bis(3-aminopropyl) methyl amine, bis(2-ethylhexyl) amine, bis(trimethylsilyl) amine, butyl amine, butyl isopropyl amine, propane diamine, propyl diamine, hexyl amine, pentyl amine, 2-methyl-cyclohexyl amine, methyl-propyl amine, methyl benzyl amine, monoethanol amine, lauryl amine, nonyl amine, trimethyl amine, triethyl amine, dimethyl propyl amine, propylene diamine, hexamethylene diamine, tetraethylene pentamine, diethyl ethanol amine, tetramethyl ammonium chloride, tetraethyl ammonium bromide, dihydroxy ethyl stearyl amine, 2-heptadecenyl-hydroxyethyl imidazoline, lauryl dimethyl benzyl ammonium chloride, cetyl pyridinium chloride, stearamid methyl pyridium chloride, a diallyl dimethyl ammonium chloride polymer, a diallyl amine polymer, and a monoallyl amine polymer.

Among these organic amine compounds, triethanol amine, triisopropanol amine, 2-amino-2-ethyl-1,3-propanediol, ethanol amine, propane diamine, and propyl amine are more preferable.

Among the above aggregating agents, polyvalent metal salts such as $Ca(NO_3)_2$, $Mg(NO_3)_2$, $Al(OH)_3$, a polyaluminum chloride, and the like, are preferably used.

The aggregating agent may be used alone or in combination of two or more kinds thereof. The content of the aggregating agent is preferably from 0.01% by weight to 30% by weight, more preferably from 0.1% by weight to 15% by weight, and further preferably from 1% by weight to 15% by weight.

The following are details of the ink.

Inks include aqueous ink containing an aqueous medium as a solvent, oily ink containing an oily medium as a solvent, UV-ray curable ink, phase-change wax ink, or the like. In the present exemplary embodiment, favorable image fixing properties may be achieved even when aqueous ink or oily ink is used with a non-permeable recording medium, without using a heater to volatilize the solvent.

Aqueous inks include inks in which water-soluble dye or pigment is dispersed or dissolved as a recording material in an aqueous medium. Oily inks include inks in which oil-soluble dye or pigment is dissolved in an oily medium and inks in which oil-soluble dye or pigment in the form of reversed micelles is dispersed in an oily medium.

When an oily ink is used, the oily ink preferably contain a low-volatile or non-volatile solvent. When oily inks are used, changes in the state of the ink due to volatilization of the solvent at the end of head nozzles may be suppressed. Further, curling or cockles may be suppressed even when the solvent permeates into the recording medium after transferring the image forming composition layer that has received ink droplets to the recording medium. The solvent contained in the oily ink may be cationic-curable.

In the present exemplary embodiment, an aqueous ink is preferably used. When aqueous inks are used, liability during maintenance or a long-term storage may be improved compared to the cases of using UV-ray curable inks or phase-change inks. Further, in this case, water-absorbing materials are preferably used as a liquid-absorbing material contained in image forming composition 12A.

As the recording material, a coloring material is typically used. Although both dyes and pigments are usable, pigments are preferred in view of durability. Both organic pigments and inorganic pigments may be used as the pigment, and black pigments include carbon black pigments such as furnace black, lamp black, acetylene black, channel black, and the like. Other than the pigments of black and three primary colors of cyan, magenta and yellow, pigments of a specific color such as red, green, blue, brown and white, pigments having a metallic luster such as gold and silver, extender pigments having no color or a pale color, may be used. Pigments that are newly synthesized for use in the present exemplary embodiments may also be used.

Further, particles formed by adhering a dye or a pigment to the surface of a core formed from silica, alumina, or polymer beads, insoluble laked products of a dye, a colored emulsion, a colored latex, or the like, may also be used as the pigment.

Specific examples of black pigments include RAVEN 7000, RAVEN' 750, RAVEN 5250, RAVEN 5000 ULTRAII, RAVEN 3500, RAVEN 2000, RAVEN 1500, RAVEN 1250, RAVEN 1200, RAVEN 1190 ULTRAII, RAVEN 1170, RAVEN 1255, RAVEN 1080 and RAVEN 1060 (trade names; manufactured by Columbian Chemicals Co.); REGAL 400R, REGAL 330R, REGAL 660R, MOGUL L, BLACK PEARLS L, MONARCH 700, MONARCH 800, MONARCH 880, MONARCH 900, MONARCH 1000, MONARCH 1100, MONARCH 1300 and MONARCH 1400 (trade names; manufactured by Cabot Corporation); COLOR BLACK FW1, COLOR BLACK FW2, COLOR BLACK FW2V, CLOR BLACK 18, COLOR BLACK FW200, COLOR BLACK S150, COLOR BLACK S160, COLOR BLACK S170, PRINTEX 35, PRINTEX U, PRINTEX V, PRINTEX 140U, PRINTEX 140V, SPECIAL BLACK 6, SPECIAL BLACK 5, SPECIAL BLACK 4A and SPECIAL BLACK 4 (trade names; manufactured by Degussa); and No. 25, No. 33, No. 40, No. 47, No. 52, No. 900, No. 2300, MCF-88, MA 600, MA 7, MA 8 and MA 100 (trade names; manufactured by Mitsubishi Chemical Corporation), but are not limited thereto.

Specific examples of cyan color pigments include C. I. PIGMENT BLUE-1, -2, -3, -15, -15:1, -15:2, -15:3, -15:4, -16, -22 and -60, but are not limited thereto.

Specific examples of magenta color pigments include C. I. PIGMENT RED-5, -7, -12, -48, -48:1, -57, -112, -122, -123, -146, -168, -177, -184, -202, and C. I. PIGMENT VIOLET-19, but are not limited thereto.

Specific examples of yellow color pigments include C. I. PIGMENT YELLOW-1, -2, -3, -12, -13, -14, -16, -17, -73, -74, -75, -83, -93, -95, -97, -98, -114, -128, -129, -138, -151, -154 and -180, but are not limited thereto.

When a pigment is used as the coloring material, it is desirable to use a dispersing agent in combination. The dispersing agents that may be used in the invention include a polymeric dispersant, an anionic surfactant, a cationic surfactant, an amphoteric surfactant, and a nonionic surfactant.

As the polymeric dispersant, polymers having both a hydrophilic structural moiety and a hydrophobic structural moiety are suitably used. The polymer having both a hydrophilic structural moiety and a hydrophobic structural moiety may be either a condensation-type polymer or an addition-type polymer. The condensation-type polymers include known polyester-type dispersants. The addition-type polymers include an addition polymer of a monomer having an α, β-ethylenic unsaturated group. The desired polymeric dispersant may be obtained by copolymerizing a monomer having an α, β-ethylenic unsaturated group and a hydrophilic group with a monomer having an α, β-ethylenic unsaturated group and a hydrophobic group. Moreover, a homopolymer of a monomer having a hydrophilic group and an α, β-ethylenic unsaturated group may also be used.

Monomers having an α, β-ethylenic unsaturated group and a hydrophilic group include monomers having a carboxyl group, a sulfonic acid group, a hydroxyl group, a phosphoric group, or the like. Specific examples thereof include acrylic acid, methacrylic acid, crotonic acid, itaconic acid, itaconic acid monoester, maleic acid, maleic acid monoester, fumaric acid, fumaric acid monoester, vinyl sulfonic acid, styrene sulfonic acid, sulfonated vinyl naphthalene, vinyl alcohol, acrylamide, methacryloxy ethyl phosphate, bismethacryloxy ethyl phosphate, methacryloxy ethyl phenyl acid phosphate, ethylene glycol dimethacrylate, and diethylene glycol dimethacrylate.

Monomers having an α, α-ethylenic unsaturated group and a hydrophobic group include styrene, styrene derivatives such as α-methyl styrene and vinyltoluene, vinyl cyclohexane, vinyl naphthalene, vinyl naphthalene derivatives, an alkyl acrylate, an alkyl methacrylate, phenyl methacrylate, an cycloalkyl methacrylate, an alkyl crotonate, an dialkyl itaconate, and an dialkyl maleate.

Preferable examples of copolymers used as a polymeric dispersant include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkylacrylate-acrylic acid copolymer, an alkylmethacrylate-methacrylic acid copolymer, a styrene-alkylmethacrylate-methacrylic acid copolymer, a styrene-alkylacrylate-acrylic acid copolymer, a styrene-phenyl methacrylate-methacrylic acid copolymer, and a styrene-cyclohexylmethacrylate-methacrylic acid copolymer. Moreover, monomers having a polyoxyethylene group or a hydroxyl group may be copolymerized with these polymers.

The above polymeric dispersants may have a weight average molecular weight of from 2,000 to 50,000, for example.

These pigment dispersants may be used singly or in combination of two or more kinds. The addition amount of the dispersants may greatly vary depending on the kind of the pigment, but is normally from 0.1% by weight to 100% by weight with respect to the amount of the pigment.

A self-dispersible pigment that can dissolve in water by itself may also be used as a coloring material. The self-dispersible pigment that can dissolve in water by itself refers to a pigment having many groups that are soluble to water on the surface of the pigment, and thus having an ability of dispersing in water without the presence of a polymeric dispersant. Specifically, the self-dispersible pigment can be obtained by subjecting a common pigment to a surface modifying treatment such as an acid/base treatment, a coupling agent treatment, a polymer graft treatment, a plasma treatment, or an oxidation/reduction treatment.

Other than the pigments that has been subjected to a surface modifying treatment as described above, examples of the pigment that is self-dispersible in water further include commercially available products such as CAB-O-JET-200, CAB-O-JET-300, IJX-157, IJX-253, IJX-266, IJX-273, IJX-444, IJX-55, and CABO-O-JET 260M, CABO-O-JET 250C, CABO-O-JET 270Y and CABO-O-JET 1027R (trade names; manufactured by Cabot Corporation), and MICROJET BLACK CW-1 and CW-2 (trade names; manufactured by Orient Chemical Industries, Ltd.).

The self-dispersible pigment preferably has at least a sulfonic acid, a sulfonic acid salt, a carboxylic acid or a carboxylic acid salt on the surface of the pigment, as a functional group. The self-dispersible pigment is more preferably a pigment having at least a carboxylic acid or a carboxylic acid salt on the surface of the pigment as a functional group.

Further, pigments covered with a resin may also be used. Such pigments are called a microcapsule pigment and include commercially available microcapsule pigments manufactured by DIC Corporation, Toyo Ink Manufacturing Co., Ltd., or the like, and microcapsule pigments experimentally prepared for the present exemplary embodiment may also be used.

Moreover, resin dispersion-type pigments prepared by physically adsorbing or chemically bonding the aforementioned polymer material to the above pigments may also be used.

Other examples of the recording material include dyes such as hydrophilic anionic dyes, direct dyes, cationic dyes, reactive dyes and polymeric dyes, and oil-soluble dyes; wax powder, resin powder or emulsions that are colored with a dye; fluorescent dyes and fluorescent pigments, infrared absorbing agents, and UV-ray absorbing agents; magnetic substances represented by ferromagnetic substances such as ferrite and magnetite; semiconductors or photocatalysts represented by titanium oxide and zinc oxide; and other organic and inorganic electronic material particles.

The content (concentration) of the recording material is, for example, in the range of from 5% by weight to 30% by weight with respect to the amount of the ink.

The volume average particle diameter of the recording material is, for example, in the range of from 10 nm to 1,000 nm.

The volume average particle diameter of the recording material refers to the particle diameter of the recording material particles themselves, or when an additive such as a dispersant is adhered to the recording material particles, refers to the particle diameter of the recording material particles including the additive attached thereto. As a measuring device of the volume average particle diameter, Microtrac UPA particle size distribution analyzer 9340 (trade name; manufactured by Leeds & Northrup) may be used. The measurement is conducted by putting 4 ml of ink in a measurement cell, and performing measurement in accordance with a predetermined measuring method. As the data to be input for the measurement, the viscosity of the ink is used as the viscosity, and the density of the dispsersed particles is used as the density of dispersed particles.

The aqueous media include water, preferably ion exchange water, ultra-pure water, distilled water, and ultrafiltration water. A water-soluble organic solvent may used in combination with the aqueous medium, and examples thereof include polyhydric alcohols, polyhydric alcohol derivatives, nitrogen-containing solvents, alcohols, sulfur-containing solvents, and the like.

Specific examples of the water-soluble organic solvent include polyhydric alcohols such as ethylene glycol, diethylene glycol, propylene glycol, butylene glycol, triethylene glycol, 1,5-pentanediol, 1,2-hexanediol, 1,2,6-hexanetriol, glycerin and trimethylol propane; sugar alcohols such as xylitol; and saccharides such as xylose, glucose, and galactose.

The polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and ethylene oxide adducts of diglycerol.

The nitrogen-containing solvents include pyrrolidone, N-methyl-2-pyrrolidone, cyclohexyl pyrrolidone and triethanol amine. The alcohols include ethanol, isopropyl alcohol, butyl alcohol and benzyl alcohol. The sulfur-containing solvents include thiodiethanol, thiodiglycerol, sulfolane and dimethyl sulfoxide.

The water-soluble organic solvent may also be propylene carbonate, ethylene carbonate, or the like.

The water-soluble organic solvent may be used singly or in combination of two or more kinds. The content of the water-soluble organic solvent is, for example, in the range of from 1% by weight to 70% by weight with respect to the amount of the ink.

Examples of the oily media include organic solvents such as aliphatic hydrocarbons, aromatic hydrocarbons, alcohols, ketones, esters, ethers, glycols, nitrogen-containing solvents, and vegetable oils. Examples of the aliphatic hydrocarbons include n-hexane, cyclohexane, methylhexane, n-octane, methylheptane, dimethylhexane, nonane and decane, and paraffin-based solvents including n-paraffin-based solvents such as ISOPAR, iso-paraffin-based solvents, and cycloparaffin-based solvents. The aromatic hydrocarbons include toluene, ethylbenzene, and xylene. The alcohols include methanol, ethanol, propanol, butanol, hexanol, and benzyl alcohol. The ketones include acetone, methylethylketone, pentanone, hexanone, heptanone, and cyclohexanone. The esters include methyl acetate, ethyl acetate, vinyl acetate, ethyl propionate, and ethyl butyrate. The ethers include diethylether, ethylpropylether, and ethylisopropylether. The glycols include ethylene glycol, diethylene glycol, propanediol, hexanediol, glycerin, and polypropylene glycol. Glycol derivatives such as ethylene glycol methylether, ethylene glycol ethylether, ethylene glycol butylether, diethylene glycol ethylether, and diethylene glycol butylether may also be used as the solvent. The vegetable oils include drying oil, semidrying oil, and nondrying oil. The drying oil includes perilla oil, linseed oil, tung oil, poppy seed oil, walnut oil, safflower oil, and sunflower oil, the semidrying oil includes rapeseed oil, and the nondrying oil includes palm oil. The above-described solvents may be used alone or in combination of two or more kinds.

The ink may also contain other additive(s) as necessary, such as a surfactant.

The surfactants include various kinds of anionic surfactants, nonionic surfactants, cationic surfactants and amphoteric surfactants. Among these, anionic surfactants and nonionic surfactants are preferably used.

Examples of the anionic surfactants include an alkyl benzene sulfonic acid salt, an alkyl phenyl sulfonic acid salt, an alkyl naphthalene sulfonic acid salt, a higher fatty acid salt, a sulfuric ester salt of a higher fatty acid ester, a sulfonic acid salt of a higher fatty acid ester, a sulfuric ester salt of a higher alcohol ether, a sulfonic acid salt of a higher alcohol ether, a higher alkyl sulfosuccinic acid salt, a polyoxyethylene alkyl ether carboxylate, a polyoxyethylene alkyl ether sulfate, an alkyl phosphate, and a polyoxyethylene alkyl ether phosphate. Among these, dodecyl benzene sulfonate, isopropylnaphthalene sulfonate, monobutylphenyl phenol mono-sulfonate, monobutyl biphenyl sulfonate, and dibutylphenyl phenol disulfonate.

Examples of the nonionic surfactants include a polyoxyethylene alkyl ether, a polyoxyethylene alkyl phenyl ether, a polyoxyethylene fatty acid ester, a sorbitan fatty acid ester, a polyoxyethylene sorbitan fatty acid ester, a polyoxyethylene sorbitol fatty acid ester, a glycerin fatty acid ester, a polyoxyethylene glycerin fatty acid ester, a polyglycerin fatty acid ester, a sucrose fatty acid ester, a polyoxyethylene alkylamine, a polyoxyethylene fatty acid amide, an alkyl alkanol amide, a polyethylene glycol-polypropylene glycol block copolymer, acetylene glycol, and polyoxyethylene-added acetylene glycol. Among these, a polyoxyethylene nonylphenyl ether, a polyoxyethylene octylphenyl ether, a polyoxyethylene dodecylphenyl ether, a polyoxyethylene alkyl ether, a polyoxyethylene fatty acid ester, a sorbitan fatty acid ester, a polyoxyethylene sorbitan fatty acid ester, a fatty acid alkylol amide, a polyethylene glycol-polypropylene glycol block copolymer, acetylene glycol, and polyoxyethylene-added acetylene glycol are preferable.

In addition, silicone-based surfactants such as a polysiloxane oxyethylene adduct, fluorine-based surfactants such as a perfluoroalkyl carboxylate, a perfluoroalkyl sulfonate, and an oxyethylene perfluoroalkyl ether, and biosurfactants such as spiculisporic acid, rhamnolipid, lysolecithin, may also be used.

The surfactant may be used singly or in combination of two or more kinds. Further, in consideration of solubility or the like, for example, the hydrophile-lipophile balance (HLB) of the surfactant may be in the range of from 3 to 20.

The addition amount of these surfactants may be, for example, in the range of from 0.001% by weight to 5% by weight, and preferably in the range of from 0.01% by weight to 3% by weight, with respect to the amount of the ink.

In addition, the ink may include a penetrant for the purpose of adjusting the permeability of the ink; polyethyleneimine, polyamines, polyvinyl pyrrolidone, polyethylene glycol, ethylcellulose, carboxymethyl cellulose, and the like, for the purpose of controlling characteristics of the ink such as ink-ejection properties; and alkali metal compounds such as potassium hydroxide, sodium hydroxide and lithium hydroxide for the purpose of adjusting the electroconductivity and the pH value of the ink. Further, a pH buffer, an antioxidant, an antifungal agent, a viscosity-controlling agent, an electric conductor, a UV-ray absorber, a chelating agent, and the like may also be added to the ink, if necessary.

In the following, characteristics of the ink will be explained. The surface tension of the ink may be, for example, in the range of from 20 mN/m to 45 mN/m.

Here, the value of the surface tension refers to the value measured by a Wilhelmy surface tensiometer (manufactured by Kyowa Interface Science Co., Ltd.) under the conditions of 23° C. and 55% RH.

The viscosity of the ink may be, for example, in the range of from 1.5 mPa·s to 30 mPa·s, preferably in the range of from 1.5 mPa·s to 20 mPa·s. Further, the viscosity of the ink is preferably lower than the viscosity of the image forming composition.

Here, the value of the viscosity refers to the value measured by a viscometer, RHEOMAT 115 (trade name; manufactured by Contraves AG), under the conditions of a measurement temperature of 23° C. and a shear rate of 1400 $s^{-1}$.

The ink used in the invention is not limited to the above-descrived compositions. Further, for example, the ink may contain a functional material such as a liquid crystal material or an electronic material, in addition to the recording material.

EXAMPLES

Hereinafter, the present invention will be explained in further details with reference to examples. However, the invention is not restricted to these examples.

Example 1

With the use of a recording apparatus having a similar configuration to the above-described first exemplary embodiment (see FIG. 1), an image forming composition layer is formed on an intermediate transfer belt by supplying an image forming composition from a composition supply unit, and ink of each color is ejected onto the image forming composition layer from respective recording heads to form an image. Subsequently, a stimulus is applied onto the image forming composition layer by a stimulus application unit while contacting the image forming composition layer with a recording medium by a transfer unit, thereby curing the image forming composition layer. Thereafter, the cured image forming composition layer is released from the intermediate transfer belt, and evaluation is carried out. In Examples, the irradiation intensity and integrated irradiation intensity described below are based on UV rays that are applied to the image forming composition layer through the intermediate transfer belt.

The following are the conditions under which Example 1 is conducted. Intermediate transfer belt: 0.1 mm in thickness; 350 mm in width; formed by coating an endless belt made of polyimide having an outer diameter of 168 mm with a ETFE resin (process speed: 400 mm/s)

Composition supply unit: a gravure roll coater (the thickness of image forming composition layer: 15 gm)

Recording head: piezo-type recording head (resolution: 1200×1200 dpi (dpi: the number of dots per inch, the same applies to the following)

Transfer unit (a pressure roller): formed by covering a steel pipe with a diameter of 30 mm with a fluorine-based resin (pressing force to the intermediate transfer belt: 2 kgf/cm in linear pressure)

Stimulus application unit: a metal halide lamp (UV-ray irradiation intensity: 240 W/cm, integrated irradiation intensity: 100 mJ/$cm^2$)

Recording medium: art paper (OK Kinfuji (trade name), manufactured by Oji Paper Co., Ltd.)

The image forming composition and the inks of respective colors are prepared in accordance with the following processes.

Image forming composition (radical curable material)

| | |
|---|---|
| Polyurethane acrylate | 40.0 parts by weight |
| Acryloyl morpholine (UV curable monomer) | 20.0 parts by weight |
| Sodium polyacrylate (liquid-absorbing particles, pulverized in a ball mill to a number-average particle diameter of 2.5 μm) | 35.0 parts by weight |
| Methyl benzoyl benzoate (photopolymerization initiator) | 5.0 parts by weight |

Black Ink

A pigment dispersion (carbon concentration: 12.8% by weight) is prepared by treating CAB-O-JET 300 (manufactured by CABOT) by an ultrasonic homogenizer for 30 minutes and a subsequent centrifugal treatment (7,000 r.p.m., 20 minutes).

Next, the following ingredients are thoroughly mixed and filtered with pressure by a 1-μm filter to prepare a black ink.

| | |
|---|---|
| Above pigment dispersion | 40.0 parts by weight |
| Glycerin | 20.0 parts by weight |
| Surfactant (SURFYNOL 465, manufactured by Nissin Chemical Industry Co., Ltd.) | 1.5 parts by weight |
| Pure water | 35 parts by weight |

<Preparation Method of Ink 1>

3 parts by weight of a salt of styrene-maleic acid copolymer neutralized with sodium is added to 30 parts by weight of a pigment and ion exchange water is further added to make the total amount of the mixture to 300 parts by weight. The obtained mixture is dispersed by an ultrasonic homogenizer and further subjected to centrifugal separation by a centrifugal separator, followed by removing 100 parts by weight of the remainder. The supernatant is filtered with a 1-μm filter to obtain a dispersion. Thereafter, 10 parts by weight of glycerin, 5 parts by weight of diethylene glycol monobutyl ether, 0.03 parts by weight of a surfactant, 3 parts by weight of isopropyl alcohol, and an appropriate amount of ion exchange water and sodium hydroxide are added to the above dispersion to make a mixture of the total amount of 100 parts by weight with a desired pigment concentration. The mixture is stirred and filtered with a 1-μm filter to obtain a desired ink.

Cyan Ink

Cyan ink is prepared in accordance with the above Preparation Method of Ink 1 having the following composition (total amount: 100 parts by weight).

| | |
|---|---|
| C. I. ACID BLUE 199 | 5.0 parts by weight |
| sryrene-maleic acid-sodium maleate copolymer | 0.3 parts by weight |
| Glycerin | 15.0 parts by weight |
| Diethylene glycol monobutyl ether | 5.0 parts by weight |
| Surfactant (SURFYNOL 465, manufactured by Nissin Chemical Industry Co., Ltd.) | 1.0 part by weight |
| Isopropyl alcohol | 3 parts by weight |
| Ion exchange water | Balance |

Magenta Ink

Magenta ink is prepared in accordance with the above Preparation Method of Ink 1 having the following composition (total amount: 100 parts by weight).

| | |
|---|---|
| C. I. ACID RED 52 | 3.5 parts by weight |
| Sryrene-maleic acid-sodium maleate copolymer | 0.3 parts by weight |
| Glycerin | 20.0 parts by weight |
| Diethylene glycol monobutyl ether | 5.0 parts by weight |
| Surfactant (SURFYNOL 465, manufactured by Nissin Chemical Industry Co., Ltd.) | 1.0 part by weight |
| Ion exchange water | Balance |

Yellow Ink

Yellow ink is prepared in accordance with the above Preparation Method of Ink 1 having the following composition (total amount: 100 parts by weight).

| | |
|---|---|
| C. I. DIRECT YELLOW 86 | 4.0 parts by weight |
| sryrene-maleic acid-sodium maleate copolymer | 0.4 parts by weight |
| Glycerin | 15.0 parts by weight |
| Diethylene glycol monobutyl ether | 10.0 parts by weight |
| Surfactant (SURFYNOL 465, manufactured by Nissin Chemical Industry Co., Ltd.) | 1.0 part by weight |
| Ion exchange water | Balance |

Example 2

Example 2 is conducted using a recording apparatus having a structure similar to the second exemplary embodiment (see FIG. 2), in a similar manner to Example 1 except that a release agent layer is formed on the intermediate transfer belt by a release agent application unit and an image forming composition layer is formed on the release agent layer by supplying an image forming composition from a composition supply unit.

In Example 2, a roll coater is used as the release agent application unit and the release agent layer is formed by applying the release agent (polypropylene wax), which has been heated, to a thickness of 1.5 μm.

Example 3

Example 3 is conducted using a recording apparatus having a structure similar to the third exemplary embodiment, by supplying an image forming composition from a composition supply unit to an intermediate transfer drum to form an image forming composition layer, and then applying inks of respective colors thereon by recording heads. A stimulus is applied from a stimulus application unit to cure the image forming composition layer while contacting the image forming composition layer to a recording medium by a transfer unit, and the cured image forming composition layer is released from the intermediate transfer drum. A stimulus is further applied by a fixing unit to completely cure the image forming composition layer, and evaluation is carried out. The following are details of the intermediate transfer drum and the fixing unit. Other conditions are the same as those described in Example 1.

Intermediate transfer drum: Glass pipe with an outer diameter of 500 mm, covered with tetrafluoroethylene-ethylene copolymer (drum (process speed): 125 mm/s)

Fixing unit: metal halide lamp (UV irradiation intensity: 240 W/cm, integrated irradiation intensity: 200 mJ/cm$^2$)

Example 4

Example 4 is conducted using a recording apparatus having a structure similar to the fourth exemplary embodiment (see FIG. 4), by supplying an image forming composition from a composition supply unit to an intermediate transfer drum to form an image forming composition layer, and then applying inks of respective colors thereon by recording heads. After a stimulus is applied from a stimulus application unit to the image forming composition layer, the image forming composition layer is brought into contact with a recording medium by a transfer unit while the image forming composition layer is not completely cured. After the image forming composition layer has been cured, it is released from the intermediate transfer drum. A stimulus is further applied by a fixing unit to completely cure the image forming composition layer, and evaluation is carried out. The image forming composition is prepared in accordance with the following process. Other conditions are the same as those described in Example 3.

Image Forming Composition (Cationic Curable Material)

| | |
|---|---|
| (3'4'-epoxycyclohexane)methyl-3,4-epoxycyclohexanecarboxylate | 60.0 parts by weight |
| 1-methyl-4-(2-methyloxylanyl)7-oxabicyclo[4.1.0]heptane | 30.0 parts by weight |

2 parts by weight of triarylsulfonium hexafluorophosphate (photopolymerization initiator) is added to the above composition, and 4-vinylcyclohexene-1,2-epoxide is further added to adjust the viscosity to 120 mPa·s.

Evaluation of Transfer Properties from Intermediate Transfer Member to Recording Medium Transfer properties (release properties) of the image forming composition layer are evaluated by visually observing the residuals remaining on the intermediate transfer member after conducting a print test for five times in a consecutive manner using art paper as a recording medium (OK Kinfuji (trade name), manufactured by Oji Paper Co., Ltd.). When the area of the portion on which the residuals remain is less than 10% of the whole surface of the intermediate transfer member, the transfer properties are evaluated as acceptable. On the other hand, when the area of the portion on which the residuals remain is 10% or more of the whole surface of the intermediate transfer member, the transfer properties are evaluated as not acceptable.

The results of the above test in Examples 1 to 4 are less than 5%, showing that acceptable transfer properties (release properties) are achieved.

Example 5 to Example 12

Example 5 is conducted using a recording apparatus having a structure similar to the fifth exemplary embodiment (see FIG. 5), by supplying an image forming composition from a composition supply unit to an intermediate transfer belt to form an image forming composition layer, and then applying inks of respective colors thereon by recording heads. UV rays are applied from a first UV irradiator to cure the image forming composition layer while contacting the image forming composition layer with a recording medium by a transfer unit, and the cured image forming composition layer is released from the intermediate transfer drum. UV rays are further applied by a second UV irradiator to completely cure the image forming composition layer, and evaluation is carried out.

The following are the conditions under which Example 5 is conducted.

Intermediate transfer belt: 0.1 mm in thickness; 350 mm in width; formed by coating an endless belt made of polyimide having an outer diameter of 168 mm with a ETFE resin (process speed: 400 mm/s)

Composition supply unit: a gravure roll coater (the thickness of the image forming composition layer: 15 μm)

Recording head: piezo-type recording head (resolution: 1200×1200 dpi (dpi: the number of dots per inch, the same applies to the following)

Transfer unit (a pressure roller): formed by covering a steel pipe with a diameter of 30 mm with a fluorine-based resin (pressing force to the intermediate transfer belt: 0.1 kgf/cm in linear pressure)

First UV irradiator: UV-LED (UV-emission diode NCCU 033 (trade name), manufactured by Nichia Corporation), condensed by a lens, plural diodes are positioned in an array, peak wavelength: 365 nm Second UV irradiator: a metal halide lamp (Vzero 140, trade name, manufactured by Integration Technology), attached with D bulb lamp Recording medium: art paper (OK Kinfuji (trade name), manufactured by Oji Paper Co., Ltd.)

The image forming composition is prepared in accordance with the following processes. The inks are the same as those used in Examples 1 to 4.

Image Forming Composition (Radical Curable Material)

| | |
|---|---|
| Polyurethane acrylate | 40.0 parts by weight |
| 1,6-hexanediol diacrylate (UV curable monomer) | 20.0 parts by weight |
| Sodium polyacrylate (liquid-absorbing particles, pulverized in a ball mill to a number-average particle diameter of 5 μm) | 35.0 parts by weight |
| IRGACURE 651 (photopolymerization initator, manufactured by Ciba Japan K.K.) | 0.2 parts by weight |

In Example 5, the transfer stimulus amount and the fixing stimulus amount are 100 mJ/cm$^2$ and 500 mJ/cm$^2$, respectively.

The values of the transfer stimulus amount and the fixing stimulus amount are measured in the following manner. Specifically, a photoreceiver (UVD-S365, manufactured by Ushio Inc.) is attached to the recording apparatus and moved under the UV irradiator.

In Example 5, the curing wavelength region is in the range of from 320 nm to 380 nm. The curing wavelength region is measured in the following manner. Specifically, the photopolymerization initator is mixed in an acetonitrile solution at a concentration of 0.10%, and an absorption spectrum is measured by a spectrometer. The entire region of wavelength of the peak around the peak intensity of absorption spectrum seen as intrinsic to the photopolymerization initiator is determined as the curing wavelength region.

In Example 5, the values of "$I_{1C}/I_{1T}$" and "$I_{2C}/I_{2T}$" are 1.0 and 0.31, respectively. The values of "$I_{1C}/I_{1T}$" and "$I_{2C}/I_{2T}$" are measured in the following manner. Specifically, an emission spectrum from the first UV irradiator (UV-LED) is measured, and the ratio of the integrated value of irradiation intensity of above-mentioned curing wavelength region ($I_{1C}$) to the integrated value of irradiation intensity in the range of 250 nm to 500 nm ($I_{1T}$)($I_{1C}/L_{1T}$) is calculated from the emission spectrum. The value of $I_{2C}/I_{2T}$ concerning the second UV irradiator (metal halide lamp) is calculated in the same manner.

The first UV irradiance (the amount of UV rays applied to the image forming composition layer by first UV irradiator through the intermediate transfer belt) and the second UV irradiance (the amount of UV rays directly applied to the image forming composition layer by second UV irradiator) measured in Examples 5 to 12 are shown in Table 1.

Evaluation of Transfer Properties from Intermediate Transfer Member to Recording Medium Transfer properties (release properties) of the image forming composition layer are evaluated by visually observing the residuals remaining on the intermediate transfer belt after conducting a print test for five times in a consecutive manner using art paper as a recording medium (OK Kinfuji (trade name), manufactured by Oji Paper Co., Ltd.), in accordance with the following criteria. The results are shown in Table 1.

A: the area of the portion with residuals is less than 1% of the whole surface of the intermediate transfer belt.

B: the area of the portion with residuals is from 1% to less than 20% of the whole surface of the intermediate transfer belt.

C: the area of the portion with residuals is 20% or more of the whole surface of the intermediate transfer belt.

Evaluation of Image Fixing Properties to Recording Medium

The surface of the sample after being subjected to the fixation using art paper as a recording medium (OK Kinfuji (trade name) is rubbed with a wiper (BEMCOT, trade name, manufactured by Asahi Kasei Fibers Corporation) and evaluated in accordance with the following criteria. The results are shown in Table 1.

A: The surface is not tacky and image disorders are hardly observed.

B: The surface is slightly tacky, but is deemed acceptable.

C: The surface is tacky and the image comes off from the substrate.

Evaluation of Durability of Intermediate Transfer Belt

Durability of the intermediate transfer belt are evaluated by visually observing the status of the intermediate transfer belt after conducting a print test for 5,000 times in a consecutive manner using art paper as a recording medium (OK Kinfuji (trade name), manufactured by Oji Paper Co., Ltd.), in accordance with the following criteria. The results are shown in Table 1.

A: Degradation of the intermediate transfer belt is hardly observed.

B: Degradation of the intermediate transfer belt is slightly observed, but is deemed acceptable.

C: Degradation of the intermediate transfer belt is observed, but is deemed acceptable.

D: Degradation of the intermediate transfer belt is distinctly observed.

Examples 13 to 16

Examples 13 and 14 are conducted and evaluated in a similar manner to Examples 5 to 12, except that a high-pressure mercury lamp (Vzero 140, manufactured by Integration Technology) attached with an H-bulb lamp is used for first UV irradiator. The results are shown in Table 1.

Examples 15 and 16 are conducted and evaluated in a similar manner to Examples 5 to 12, except that a metal halide lamp (Vzero 140, manufactured by Integration Technology) attached with an A-bulb lamp is used for first UV irradiator. The results are shown in Table 1.

TABLE 1

| | UV irradiation | | Evaluation | | | |
|---|---|---|---|---|---|---|
| | First UV irradiance ($mJ/cm^2$) | Second UV irradiance ($mJ/cm^2$) | Image fixing properties | Durability of intermediate transfer belt | Transfer properties | Notes |
| Example 5 | 10 | 0 | C | A | B | Comparative |
| Example 6 | 110 | 0 | C | A | A | Comparative |
| Example 7 | 1200 | 0 | B | D | A | Comparative |
| Example 8 | 0 | 1200 | B | A | C | Comparative |
| Example 9 | 1200 | 510 | B | D | A | Comparative |
| Example 10 | 13 | 820 | B | A | B | Comparative |
| Example 11 | 110 | 510 | B | A | A | The invention |
| Example 12 | 1200 | 900 | A | A | A | The invention |
| Example 13 | 130 | 510 | B | B | A | The invention |
| Example 14 | 120 | 1000 | A | B | A | The invention |
| Example 15 | 110 | 530 | B | C | A | The invention |
| Example 16 | 150 | 1100 | A | C | A | The invention |

As shown in Table 1, Examples 11 to 16 exhibit superior results in transfer properties, image fixing properties, and durability of the intermediate transfer belt, as compared with the cases of Examples 5 to 10.

All publications, patent applications, and technical standards mentioned in this specification are herein incorporated by reference to the same extent as if each individual publication, patent application, or technical standard was specifically and individually indicated to be incorporated by reference.

What is claimed is:

1. A method of forming an image, comprising:

forming an image forming composition layer by supplying an image forming composition liquid to an intermediate transfer member, the image forming composition liquid containing a curable material that cures upon application of an external stimulus;

applying an ink to the image forming composition layer that has been formed on the intermediate transfer member, the ink being an ink in which a water-soluble dye or pigment is dispersed or dissolved in an aqueous medium, and which does not contain a curable material;

transferring the image forming composition layer from the intermediate transfer member to a recording medium by contacting the image forming composition layer onto which the ink has been applied with the recording medium;

applying a first stimulus to the image forming composition layer that cures the image forming composition layer, the first stimulus being applied at least one of immediately before the image forming composition layer comes into contact with the recording medium, or during the contact; and applying a second stimulus that cures the image forming composition layer, the second stimulus being applied to the image forming composition layer after it has been released from the intermediate transfer member;

wherein the first stimulus and the second stimulus are each light including UV rays, and a ratio represented by $I_{1C}/I_{1T}$ is larger than a ratio represented by $I_{2C}/I_{2T}$, and wherein:

$I_{1T}$ is an integrated irradiation intensity of the light including UV rays in a wavelength range of from 250 nm to 500 nm, and $I_{1C}$ is an integrated irradiation intensity of the light including UV rays in a wavelength range that cures the image forming composition layer; and $I_{2T}$ is an integrated irradiation intensity of the light including UV rays in a wavelength range of from 250 nm to 500 nm, and $I_{2C}$ is an integrated irradiation intensity of the light including UV rays in a wavelength range that cures the image forming composition layer.

2. The method according to claim 1, wherein a surface of the intermediate transfer member that contacts the image forming composition layer has a surface free energy is less than a surface free energy of a surface of the recording medium that contacts the image forming composition layer.

3. The method according to claim 2, wherein the surface of the intermediate transfer member that contacts the image forming composition liquid contains a fluorine-based resin.

4. The method according to claim 1, wherein the first stimulus is applied to the image forming composition layer through the intermediate transfer member.

5. The method according to claim 3, wherein the first stimulus is applied from the inside of the intermediate transfer member.

6. The method according to claim 1, wherein the curable material is selected from the group consisting of a UV-ray curable material, an electron-beam curable material, and a thermally curable material.

7. The method according to claim 1, wherein the amount of the first stimulus is not less than the amount of the stimulus that cures the image forming composition layer to a curing ratio of about 10% but less than the amount of the stimulus that cures the image forming composition layer to a curing ratio of about 80%, and the total amount of the first stimulus and the second stimulus is not less than the amount of the stimulus that cures the image forming composition layer to a curing ratio of about 80%.

8. The method according to claim 1, wherein the first stimulus is supplied from an UV-emission diode.

* * * * *